US009706859B2

(12) United States Patent
Brinton, Jr. et al.

(10) Patent No.: US 9,706,859 B2
(45) Date of Patent: Jul. 18, 2017

(54) HANGER ASSEMBLIES FOR USE IN STORAGE SYSTEMS

(71) Applicant: Clairson, Inc., Newark, DE (US)

(72) Inventors: Daniel Wayne Brinton, Jr., Ocala, FL (US); Ernie Junior Torres, Gainesville, FL (US); Milind S. Nimgulkar, Pune (IN); Robert B. Anderson, III, Ocala, FL (US)

(73) Assignee: Clairson, Inc., Newark, DE (US)

( * ) Notice: Subject to any disclaimer, the term of this patent is extended or adjusted under 35 U.S.C. 154(b) by 99 days.

(21) Appl. No.: 14/731,752

(22) Filed: Jun. 5, 2015

(65) Prior Publication Data

US 2015/0265069 A1 Sep. 24, 2015

Related U.S. Application Data

(63) Continuation-in-part of application No. 14/042,902, filed on Oct. 1, 2013, now Pat. No. 9,049,931.

(30) Foreign Application Priority Data

Aug. 23, 2013 (IN) ..... 2756/MUM/2013

(51) Int. Cl.
*A47B 96/06* (2006.01)
*A47F 5/01* (2006.01)
(Continued)

(52) U.S. Cl.
CPC ..... *A47F 5/01* (2013.01); *A47B 61/003* (2013.01); *A47B 96/02* (2013.01); *A47B 97/00* (2013.01); *A47F 7/24* (2013.01); *A47G 25/06* (2013.01)

(58) Field of Classification Search
CPC ..... A47F 5/00; A47F 5/01; A47F 7/24; A47F 25/06; A47G 25/06; A47B 61/003;
(Continued)

(56) References Cited

U.S. PATENT DOCUMENTS 505,360 A 9/1893 Hilliard
560,884 A * 5/1896 Anderson ..... A47B 96/061 248/249

(Continued)

OTHER PUBLICATIONS

U.S. Appl. No. 14/042,902, filed Oct. 1, 2013, Brinton et al.

*Primary Examiner* — Nkeisha Smith
(74) *Attorney, Agent, or Firm* — Harness, Dickey & Pierce, P.L.C.

(57) ABSTRACT

A hanger assembly for a wire shelf includes at least one bracket configured to releasably couple to wire members of the wire shelf. The bracket includes a hook-shaped end portion that defines a channel for receiving a first one of the wire members and an elbow portion that defines a bend for receiving a second one of the wire members to thereby releasably couple the bracket to the wire shelf. The bracket may further include a second end portion opposite the hook-shaped end portion and a U-shaped portion defined between the elbow portion and the second end portion such that the second end portion extends generally back towards the elbow portion and the hook-shaped portion. A rod may be coupled to the bracket. Also disclosed are saddles for coupling to the brackets and receiving a rod, and a rod joiner for coupling between rods.

19 Claims, 22 Drawing Sheets

(51) Int. Cl.

| | |
|---|---|
| ***A47B 61/00*** | (2006.01) |
| ***A47B 96/02*** | (2006.01) |
| ***A47B 97/00*** | (2006.01) |
| *A47F 7/24* | (2006.01) |
| *A47G 25/06* | (2006.01) |

(58) Field of Classification Search

CPC ..... A47B 96/02; A47B 97/00; A47B 96/06; F16B 7/0433; F16B 12/38

USPC ..... 248/339, 58, 61, 65, 73, 68.1, 249, 250, 248/304, 301–303, 305, 229.15, 229.25, 248/228.6, 230.6, 231.71; 211/134, 153, 211/123, 90.03, 105.1, 162

See application file for complete search history.

(56) References Cited

U.S. PATENT DOCUMENTS 1,347,808 A 7/1920 Franklin
2,120,748 A 6/1938 Harris
2,361,943 A * 11/1944 Issoglio ..... F16L 3/2235 174/135
2,937,835 A * 5/1960 Csmereka ..... F16L 3/1091 248/68.1
3,180,598 A * 4/1965 Girard ..... F16L 3/222 248/68.1
3,765,634 A 10/1973 Stempel
3,773,288 A * 11/1973 Bolton ..... A47G 29/083 248/205.1
3,921,814 A 11/1975 Solomon
4,316,593 A 2/1982 Miner et al.
4,374,498 A 2/1983 Yellin
4,777,888 A 10/1988 Waterman et al.
5,285,364 A * 2/1994 Bayer ..... F21V 5/06 24/698.3
5,294,156 A * 3/1994 Kumazaki ..... F25B 41/003 285/124.2
D349,000 S 7/1994 Rogers et al.
5,350,072 A 9/1994 Rogers et al.
5,351,842 A 10/1994 Remmers
D352,195 S 11/1994 Rogers et al.
5,405,026 A 4/1995 Lee et al.
5,476,240 A * 12/1995 McDonough ..... A46B 17/02 211/65
5,492,295 A 2/1996 Remmers
5,520,118 A 5/1996 McCarthy
5,531,416 A * 7/1996 Remmers ..... A47B 61/003 211/105.1
5,695,080 A 12/1997 Martin
5,725,110 A 3/1998 Kluge et al.
5,758,851 A * 6/1998 Remmers ..... A47B 61/003 211/105.1
D427,466 S 7/2000 Remmers
D437,515 S 2/2001 Remmers et al.
6,340,141 B1 1/2002 Rinderer
6,540,531 B2 * 4/2003 Syed ..... H01R 9/0524 174/68.3
6,602,016 B2 * 8/2003 Eckart ..... F16L 3/1033 403/110
6,913,235 B2 7/2005 Oberhaus
7,004,335 B2 2/2006 Remmers
7,086,544 B1 8/2006 Doench
D527,559 S 9/2006 Remmers
D527,935 S 9/2006 Remmers
7,185,772 B2 * 3/2007 Remmers ..... A47B 96/021 211/153
7,392,911 B2 7/2008 Stitchick et al.
D578,869 S 10/2008 Fernandez
D580,258 S 11/2008 Fernandez
7,516,930 B2 * 4/2009 Chen ..... F16B 7/0433 248/304
7,543,782 B2 * 6/2009 Cummins ..... B44D 3/123 248/112
D621,244 S 8/2010 Kundinger, Jr. et al.
7,900,783 B2 3/2011 Fernandez et al.
7,946,549 B2 * 5/2011 Forrest ..... A47B 96/06 248/235
8,177,172 B2 5/2012 Quertelet et al.
8,348,204 B2 * 1/2013 Kataoka ..... B61D 49/00 174/135
8,646,624 B2 2/2014 Fernandez et al.
8,910,805 B2 12/2014 Gregory et al.
2004/0045920 A1 3/2004 Remmers
2005/0077261 A1 4/2005 Remmers
2005/0173597 A1 * 8/2005 Farrell ..... F16L 3/22 248/68.1
2005/0230577 A1 * 10/2005 Chen ..... A47B 55/02 248/215
2006/0091266 A1 * 5/2006 Leiser ..... B29C 45/14614 248/68.1
2006/0261230 A1 * 11/2006 Lee ..... A47B 61/003 248/304
2007/0108146 A1 5/2007 Nawrocki
2007/0114197 A1 * 5/2007 Remmers ..... A47B 96/021 211/153
2007/0252061 A1 * 11/2007 Feetham ..... A47F 5/0006 248/302
2008/0000181 A1 * 1/2008 Sillik ..... E04B 1/7654 52/404.3
2009/0139943 A1 * 6/2009 Fernandez ..... A47B 45/00 211/94.01
2009/0218451 A1 * 9/2009 Lundborg ..... F16L 5/02 248/56
2010/0148018 A1 * 6/2010 Schoenau ..... F16L 5/14 248/74.4
2012/0280092 A1 * 11/2012 Barre ..... F16L 3/237 248/68.1
2015/0060383 A1 3/2015 Gregory et al.
2016/0106085 A1 * 4/2016 Boots ..... A01K 97/10 248/219.1

* cited by examiner

DETAIL A

SECTION A-A

HANGER ASSEMBLIES FOR USE IN STORAGE SYSTEMS

CROSS-REFERENCE TO RELATED APPLICATIONS

This application is a continuation-in-part of U.S. patent application Ser. No. 14/042,902 filed Oct. 1, 2013, which, in turn, claims the benefit and priority of India Patent Application No. 2756/MUM/2013 filed Aug. 23, 2013. The entire disclosures of the above applications are incorporated herein by reference.

FIELD

The present disclosure generally relates to storage systems and, more particularly, to hanger assemblies for use in such storage systems.

BACKGROUND

This section provides background information related to the present disclosure which is not necessarily prior art.

Efficient and organized use of building space is very desirable, particularly with respect to storage or utility space in both businesses and residential settings. Because of limited or tight spaces in these locations, maximizing the amount of useable space is very important. Likewise, providing ease in accessing stored items, such as clothing, is important. Further, ease in moving stored items to make room for other items or to access items not readily accessible, is likewise important.

SUMMARY

This section provides a general summary of the disclosure, and is not a comprehensive disclosure of its full scope or all of its features.

Example embodiments of the present disclosure generally relate to storage systems. In one example embodiment, a shelving unit suitable for use in a storage system generally includes a wire shelf having multiple wire members arranged to form a platform, a bracket configured to releasably couple to wire members of the wire shelf, and a rod coupled to the bracket. The bracket includes a hook-shaped end portion and an elbow portion. The hook-shaped end portion of the bracket defines a channel that opens toward the elbow portion for receiving a first one of the wire members, and the elbow portion of the bracket defines a bend for receiving a second one of the wire members to thereby releasably couple the bracket to the wire shelf. In various aspects of the present disclosure, the coupling between the bracket and the wire members of the wire shelf is a snap-fit coupling that allows, for example, the brackets to be coupled to the wire members, uncouple from the wire members, and recouple to the wire members as desired.

In another example embodiment, a shelving unit generally includes a wire shelf having multiple wire members arranged to form a platform, a bracket configured to releasably couple to the wire shelf, and a rod coupled to the bracket. The bracket includes an end portion configured to receive a first one of the wire members of the wire shelf and an elbow portion configured to receive a second one of the wire members of the wire shelf. The bracket also includes a lip portion disposed adjacent the elbow portion, where a distance between the end portion of the bracket and the lip portion is less than a distance between the end portion of the bracket and the elbow portion such that the lip portion operates to at least partially retain the second one of the wire members in the elbow portion when the bracket is releasably coupled to the wire shelf.

Example embodiments of the present disclosure also generally relate to hanger assemblies for use with wire shelves (e.g., as part of storage systems, shelving units, etc.). In one example embodiment, a hanger assembly generally includes at least one bracket configured to releasably couple to a wire shelf, and a rod coupled to the at least one bracket. The at least one bracket includes a border (e.g., extending from end portion to end portion of the bracket, etc.) defining a common interior region for receiving wire members of the wire shelf therein when releasably coupling the at least one bracket to the wire shelf.

In another example embodiment, a hanger assembly generally includes at least one bracket configured to releasably couple to wire members of a wire shelf. The bracket includes a hook-shaped end portion and an elbow portion. The hook-shaped end portion of the bracket defines a channel that opens toward the elbow portion for receiving a first one of the wire members, and the elbow portion of the bracket defines a bend for receiving a second one of the wire members to thereby releasably couple the bracket to the wire shelf with the first and second one of the wire members disposed within a common interior region defined between the hook-shaped end portion and the elbow portion when the bracket is releasably coupled to the wire shelf. The bracket further includes a second end portion opposite the hook-shaped end portion and a U-shaped portion defined between the elbow portion and the second end portion such that the second end portion extends generally back towards the elbow portion and the hook-shaped portion. The hanger assembly also includes a rod coupled to the bracket In another example embodiment, a hanger assembly generally includes at least two brackets configured to releasably couple to wire members of a wire shelf. Each bracket includes a hook-shaped end portion and an elbow portion. The hook-shaped end portion of the bracket defines a channel that opens toward the elbow portion for receiving a first one of the wire members, and the elbow portion of the bracket defines a bend for receiving a second one of the wire members to thereby releasably couple the bracket to the wire shelf. The assembly also includes a first rod coupled to a first of the at least two brackets, a second rod coupled to a second of the at least two brackets, and a rod joiner coupled between the first rod and the second rod to space the first rod and the second rod apart. The rod joiner defines a first opening at a first end for receiving the first rod and a second opening at a second end for receiving the second rod In yet another example embodiment, a hanger assembly generally includes a bracket configured to releasably couple to wire members of a wire shelf. Each bracket includes a hook-shaped end portion and an elbow portion. The hook-shaped end portion of the bracket defines a channel that opens toward the elbow portion for receiving a first one of the wire members, and the elbow portion of the bracket defines a bend for receiving a second one of the wire members to thereby releasably couple the bracket to the wire shelf. The bracket further includes a second end portion opposite the hook-shaped end portion. The hanger assembly also includes a saddle having an upper saddle portion and a lower saddle portion with an opening for receiving the second end portion of the bracket to thereby mount the saddle to the bracket. The upper saddle portion is configured to receive at least a portion of the hang rod therein. The hanger assembly also includes a rod received in and supported by the upper saddle portion of the saddle.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

FIGS. 1-7 illustrate an example embodiment of a shelving unit 100 including one or more aspects of the present disclosure. The shelving unit 100 can be used to store desired items and may, for example, form part of a closet storage system within the scope of the present disclosure (see, e.g., closet storage system 540 in FIG. 17, etc.).

Figure 1:
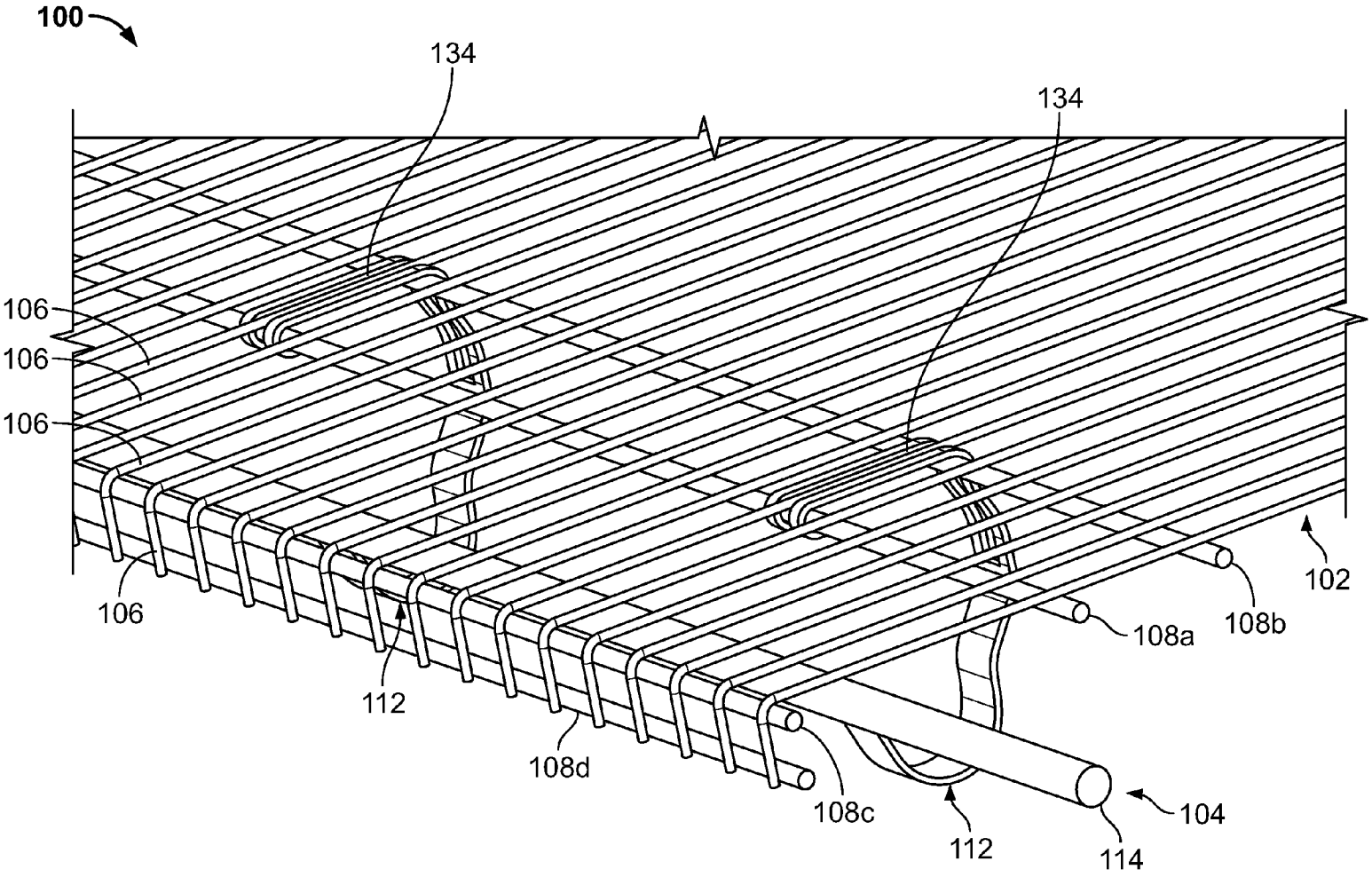
FIG. 1 is a perspective view of a shelving unit according to an example embodiment of the present disclosure.

As shown in FIG. 1, the shelving unit 100 generally includes a wire shelf 102 and a hanger assembly 104 configured to couple thereto. The wire shelf 102 provides a surface for holding, stacking, etc. items on the shelving unit 100. And, the hanger assembly 104 allows for hanging desired items using, for example, clothes hangers, etc. from the shelving unit 100. The wire shelf 102 can have any desired size (e.g., a twelve inch depth, a sixteen inch depth, etc.), and the hanger assembly 104 can be coupled to the wire shelf 102 at any desired location (e.g., at a twelve inch hang, etc.).

The wire shelf 102 generally includes multiple wire members arranged to form a platform (e.g., for stacking, storing, etc. items). The wire members include multiple wire stringers 106, and multiple support members 108*a-d* arranged generally transverse to the wire stringers 106 for providing support to the wire stringers 106. The wire stringers 106 are spaced to provide a ventilated structure for the wire shelf 102 while preventing relatively large items stored on the wire shelf 102 from passing between spaces between the wire members. Other configurations and/or arrangements of the wire members of the wire shelf 102 are possible as aspects of the present disclosure are not limited to any particular number, shape, size, and/or arrangement of wire members. In one example, non-limiting aspect, wire stringers of a wire shelf may be formed from 4.5 gauge wire and spaced apart about two inches. However, other sizes and/or spacing may be used.

Figure 2:
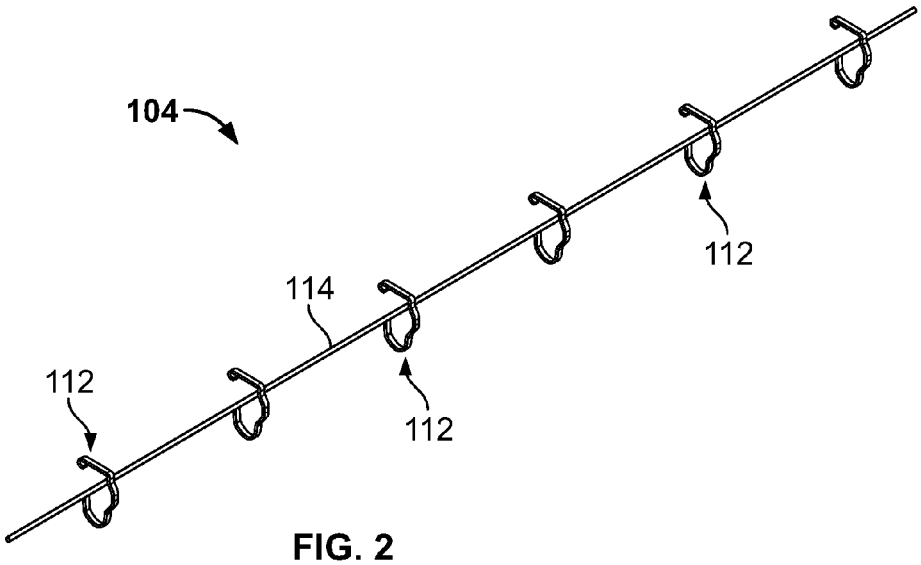
FIG. 2 is a perspective view of a hanger assembly of the shelving unit of FIG. 1.
Figure 3:
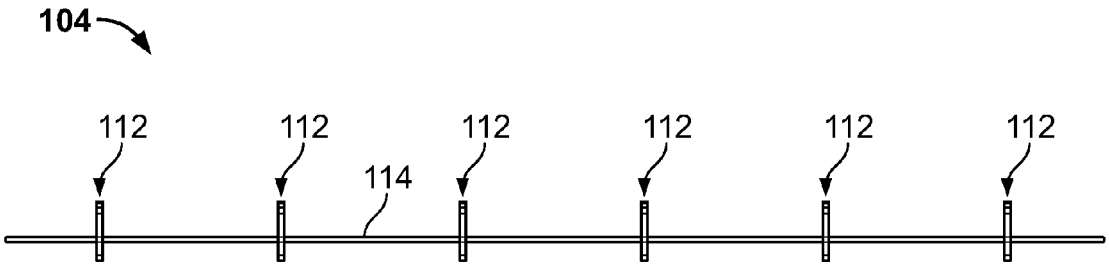
FIG. 3 is a front elevation view of the hanger assembly of FIG. 2.
Figure 17:
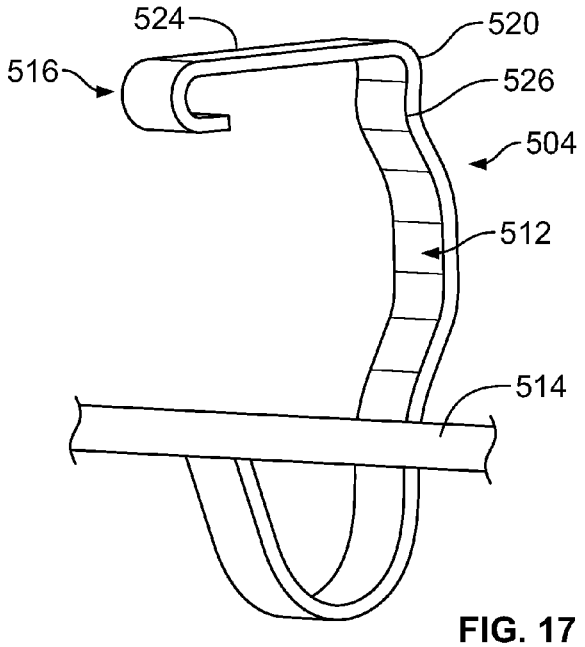
FIG. 17 is a fragmentary perspective view of a hanger assembly of the storage system of FIG. 16.

With additional reference to FIGS. 2 and 3, the hanger assembly 104 includes multiple brackets 112 for use in coupling the hanger assembly 104 to the wire shelf 102. As will be described, the brackets 112 are configured to releasably couple to wire members (e.g., support members 108*a*, 108*b*, etc.) of the wire shelf 102 (e.g., via a snap fit, an interference fit, via a hanging fit, without welding, etc.). A rod 114 is coupled (e.g., releasably coupled, fixedly coupled (e.g., welded as shown in FIG. 17, etc.), etc.) to the brackets 112 for accommodating hanging items from the hanger assembly 104, for example, to allow a clothes hanger to slide along the rod 114 freely past the brackets 112 without interference therefrom. Other items (other than hangers, other than clothes, etc.) may be suspended from the rod 114 within the scope of the present disclosure. The rod 114 is disposed generally parallel to the support members 108*a-d* of the wire shelf 102 when the hanger assembly 104 is coupled thereto.

In some exemplary embodiments, the rod 114 is releasably coupled to the brackets 112, which, in turn are releasably coupled to the wire shelf 102. Accordingly, the rod 114 may be detached from the brackets 112, and the brackets 112 may be detached from the wire shelf 102. In which case, the rod 114, brackets 112, and wire shelf 102 may be packaged for shipping, storage, etc. in a single relatively small package or in multiple separate packages. The package may be shipped to a customer, who would then assemble the brackets 112 to the wire shelf 102 and the rod 114 to the brackets 112, or vice versa. In other exemplary embodiments, the brackets 112 are releasably coupled to the wire shelf 102, but the rod 114 is fixedly coupled to the brackets 112. In these other exemplary embodiments, the brackets 112 may be detached from the wire shelf 102. Then, for example, the brackets 112 with the rod 114 attached thereto may be packaged, shipped, stored, etc. separately from the wire shelf 102.

In the exemplary embodiment shown in FIGS. 1 through 7, each of the brackets 112 of the hanger assembly 104 is substantially similar or identical. As such, one of the brackets 112 will be described next with it understood that a description of the other brackets 112 is substantially the same. Alternative embodiments may, however, include one or more brackets different than the other brackets.

Figure 4:
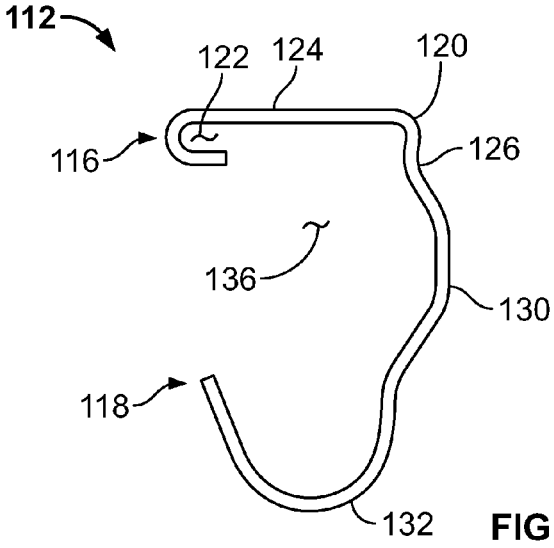
FIG. 4 is a side elevation view of a bracket of the hanger assembly of FIG. 2.

As shown in FIG. 4, the bracket 112 is generally C-shaped and is defined by a generally flat piece of material having generally uniform thickness along an entire length of the bracket 112. As an example, the bracket 112 may be formed by rolling a cylindrical, round rod or wire to a flat shape (e.g., such that the bracket 112 is also strain hardened, thereby cold working the material to provide greater stiffness and thus less deflection when subjected to loading than the base "pre-worked" material, etc.), and then forming the flat wire to the desired shape of the bracket 112. This example bracket 112 may be referred to as a snap-on flat wire bracket 112. A width of the bracket 112 may be any desired dimension within the scope of the present disclosure, for example, a width substantially matching a width between the stringers 106 of the wire shelf 102, etc. As another example, the bracket 112 may be formed from sheet metal, etc. As still another example, the bracket 112 may be formed from a wire bent to a desired shape (e.g., without rolling the wire to a flat shape, etc.). In other example embodiments, brackets may be formed from plastics or other suitable materials.

The bracket 112 generally includes first and second end portions 116, 118, and an elbow portion 120. The first end portion 116 is generally hook-shaped and defines a channel 122 that opens toward a rearward portion of the bracket 112 (generally toward the right in FIG. 4) (and generally toward the elbow portion 120). A generally straight upper member 124 extends between the first end portion 116 and the elbow portion 120. A rounded lip portion 126 is located generally below the elbow portion 120 and protrudes toward a forward portion of the bracket 112 (toward the left in FIG. 4). As such, the elbow portion 120 defines a generally rounded bend having a radial angle that is slightly greater than about ninety degrees. The bracket 112 further includes a bump-out 130 generally below the lip portion 126, and then a U-shaped portion 132 leading to the second end portion 118. With reference again to FIGS. 1-3, the rod 114 couples to the second end portion 118 of the bracket 112 which (along with the general shape of the bracket 112) thereby facilitates the movement of the clothes hanger along the rod 114 freely past the bracket 112 without interference therefrom.

In making the hanger assembly 104, a long length of the rod 114 may initially have multiple brackets 112 coupled thereto. The rod 114 can then be cut (e.g., at locations between the brackets 112, etc.) to any desired length (e.g., a six foot length, a twelve foot length, etc.) to thereby form the hanger assembly 104 with the desired length. The rod 114 and/or the brackets 112 may also be epoxy coated within the scope of the present disclosure to provide smooth surfaces (and low sliding friction). With that said, the illustrated hanger assembly 104 includes six brackets 112 positioned at generally uniform intervals (e.g., about twelve inch intervals, intervals greater than about twelve inches, intervals less than about twelve inches, etc.) along the rod 114. And, the rod 114 extends a distance (e.g., about six inches, a distance greater than about six inches, a distance less than about six inches, etc.) beyond each of the end brackets 112. Also in this example, the rod 114 may have an overall length of about 72 inches (e.g., 72.39 inches, etc.) and a diameter of about ¼ inch (e.g., 0.28 inches or 7 millimeters, etc.). In other example embodiments, hanger assemblies can include more than or fewer than six brackets and/or have other sizes than disclosed herein. For example, a hanger assembly (e.g., hanger assembly 304 in FIG. 12, etc.) may include a rod having an overall length of about 144 inches (e.g., 144.39 inches, etc.) and twelve brackets positioned at generally uniform intervals (e.g., about twelve inch intervals, intervals greater than about twelve inches, intervals less than about twelve inches, etc.) along the rod. Also in the illustrated embodiment, the rod 114 is shown as a generally hollow tube (e.g., metal tube, plastic tube, etc.). And, the second end portion 118 of each of the brackets 112 extends generally into the hollow portion of the rod 114 when the brackets 112 and the rod 114 are coupled together (see, e.g., FIGS. 6 and 7, etc.). But the rod 114 could alternatively be a solid metal rod 114 (e.g., a one gauge size solid metal rod, etc.), a plastic rod 114, etc. within the scope of the present disclosure.

Figure 5:
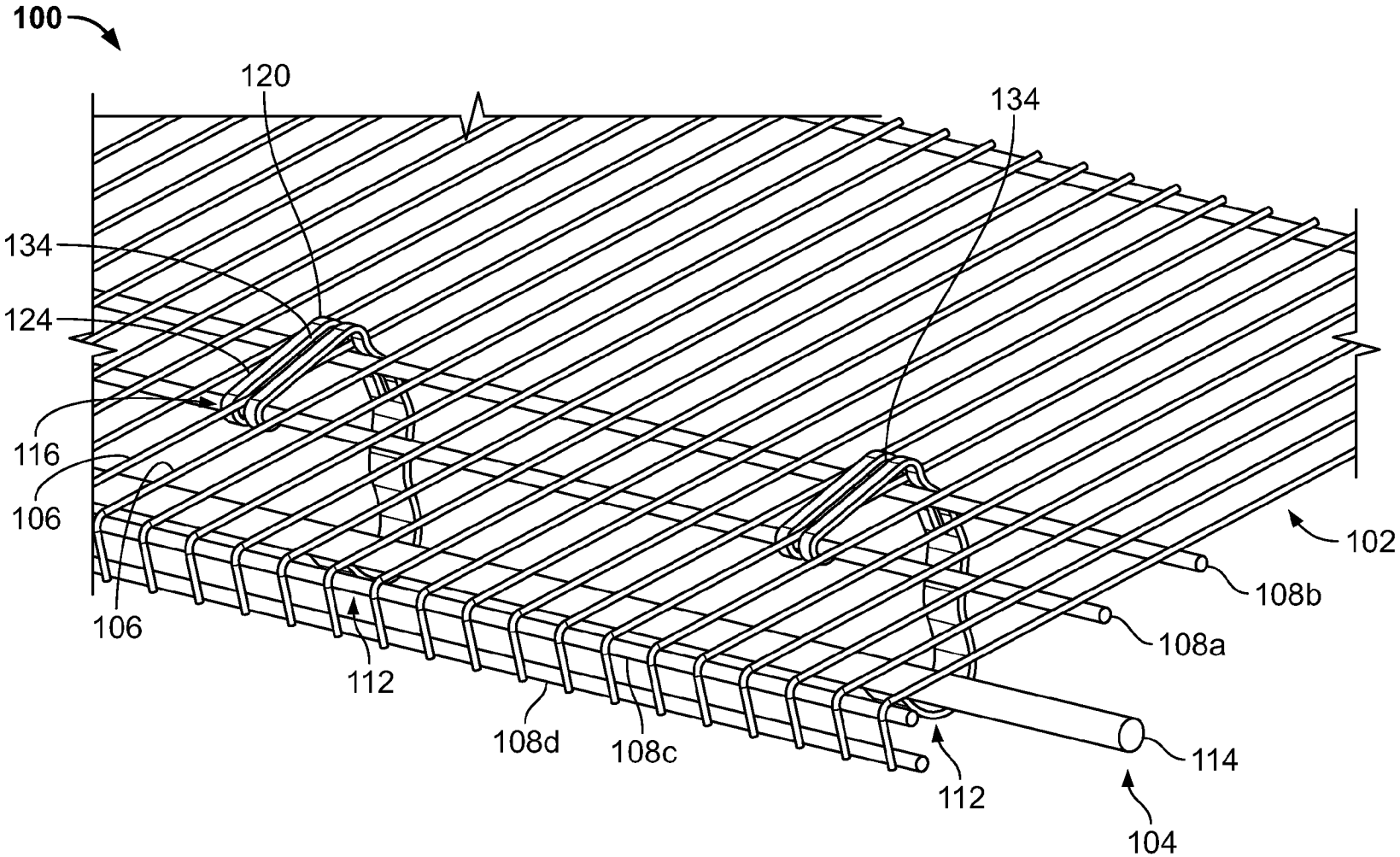
FIG. 5 is another perspective view of the shelving unit of FIG. 1, illustrating installation of the hanger assembly to a wire shelf of the shelving unit.
Figure 6:
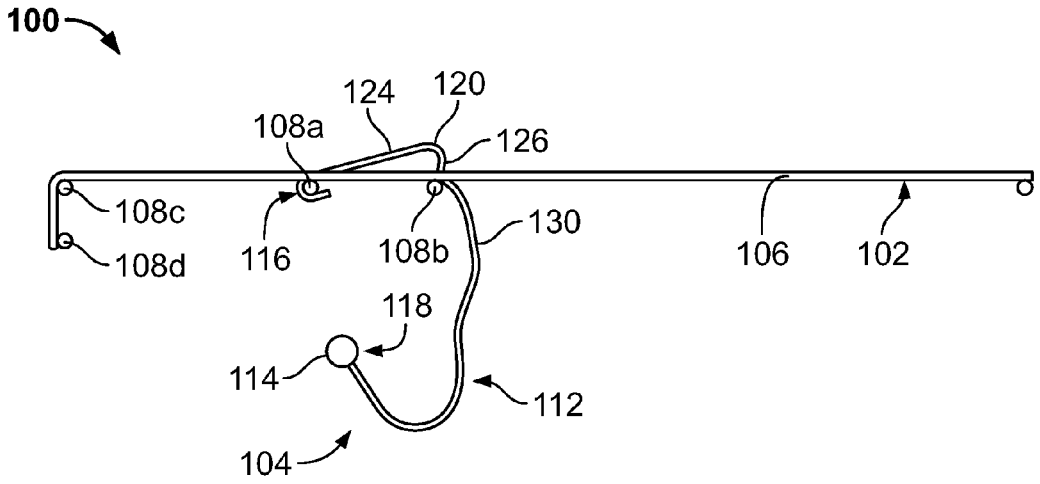
FIG. 6 is a side elevation view of the shelving unit of FIG. 5, illustrating the installation of the hanger assembly to the wire shelf of the shelving unit.
Figure 7:
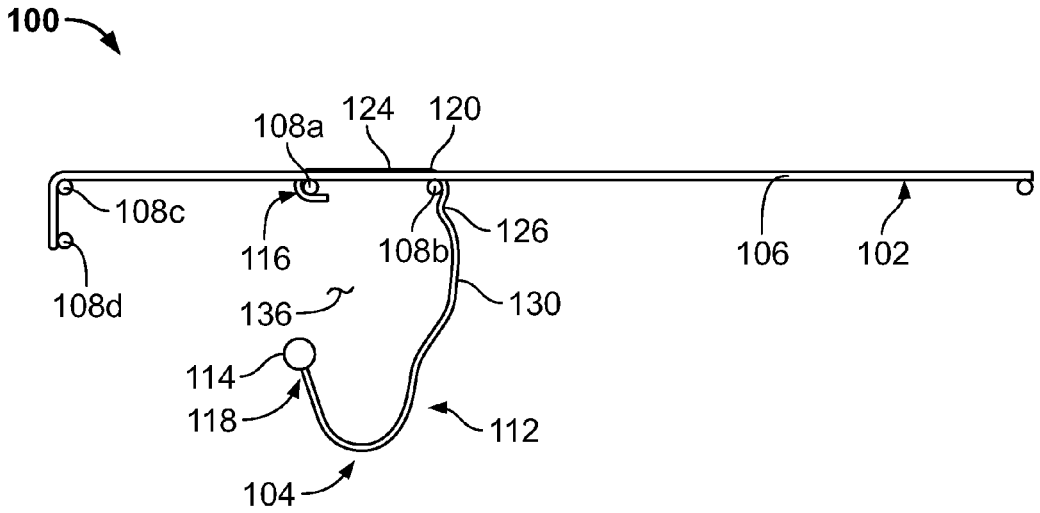
FIG. 7 is a side elevation view of the shelving unit of FIG. 1, illustrating the hanger assembly installed to the wire shelf of the shelving unit.
Figure 8:
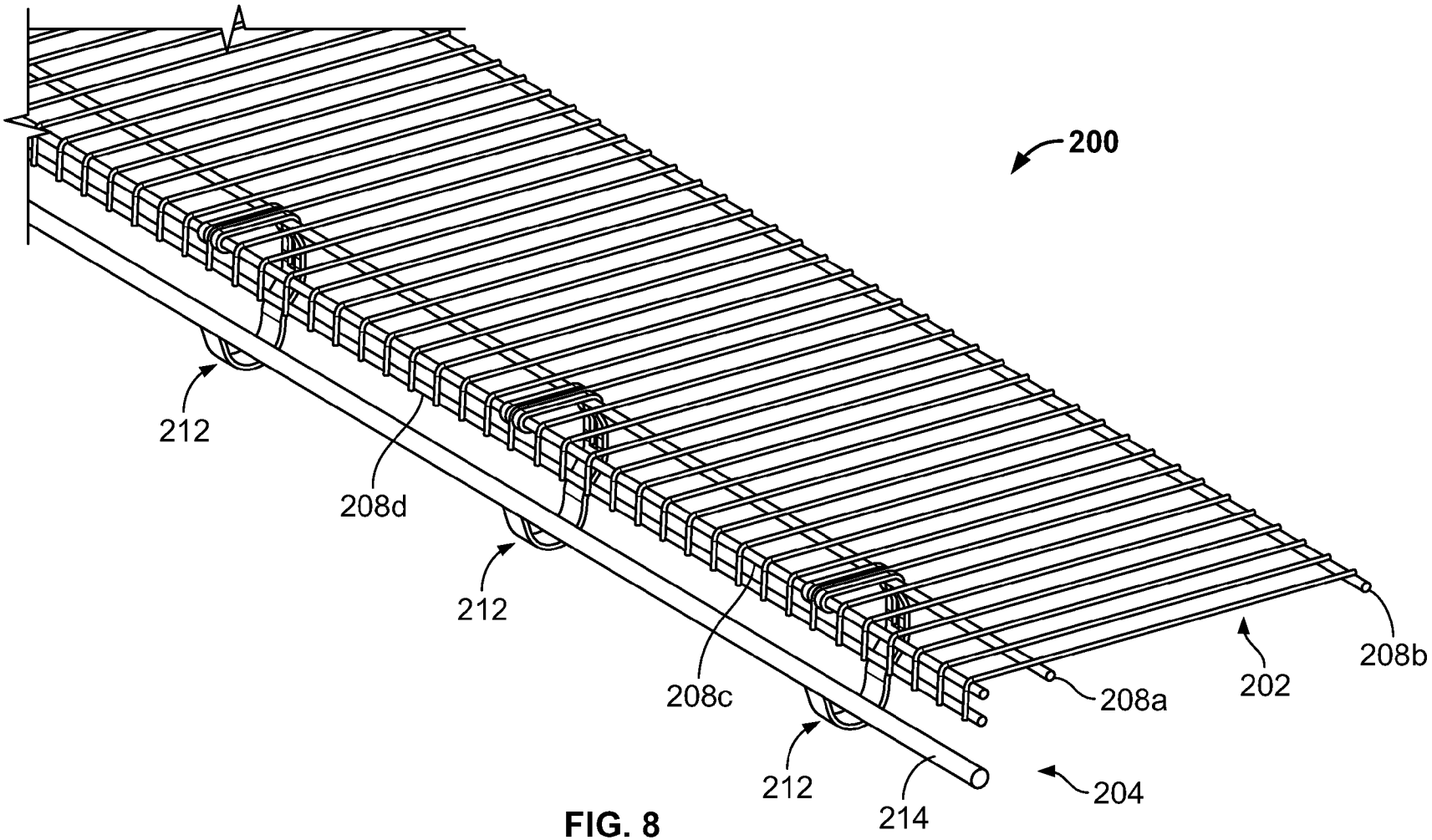
FIG. 8 is a perspective view of a shelving unit according to another example embodiment of the present disclosure.
Figure 9:
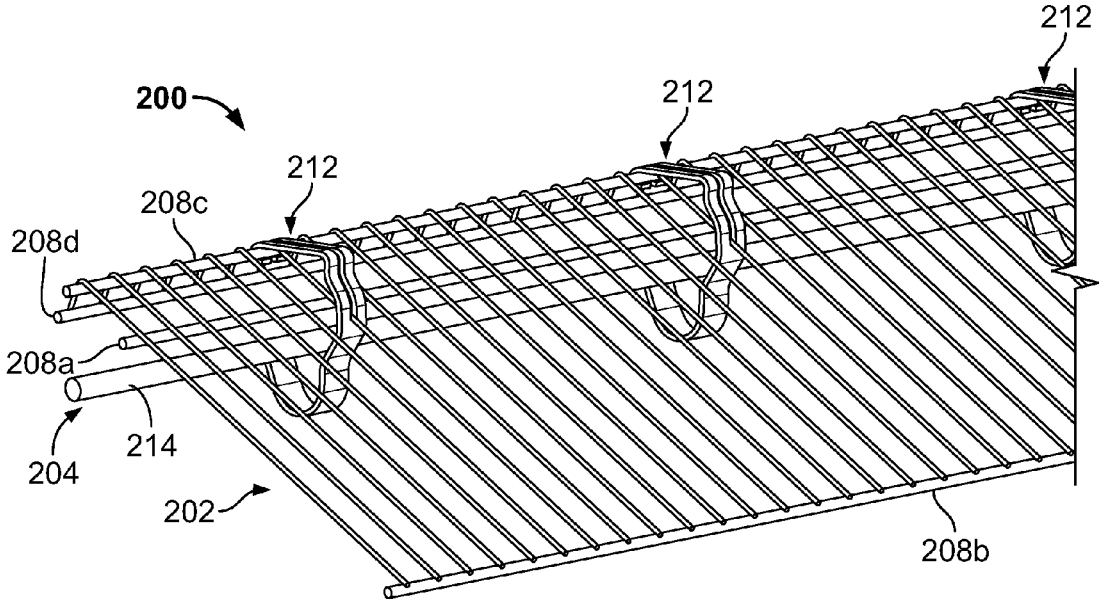
FIG. 9 is another perspective view of the shelving unit of FIG. 8, illustrating installation of a hanger assembly to a wire shelf of the shelving unit.
Figure 10:
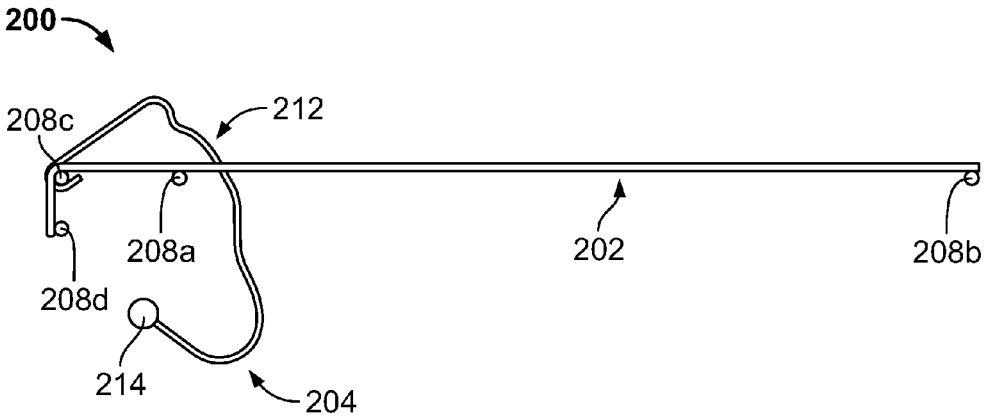
FIG. 10 is a side elevation view of the shelving unit of FIG. 9, illustrating installation of the hanger assembly to the wire shelf of the shelving unit.
Figure 11:
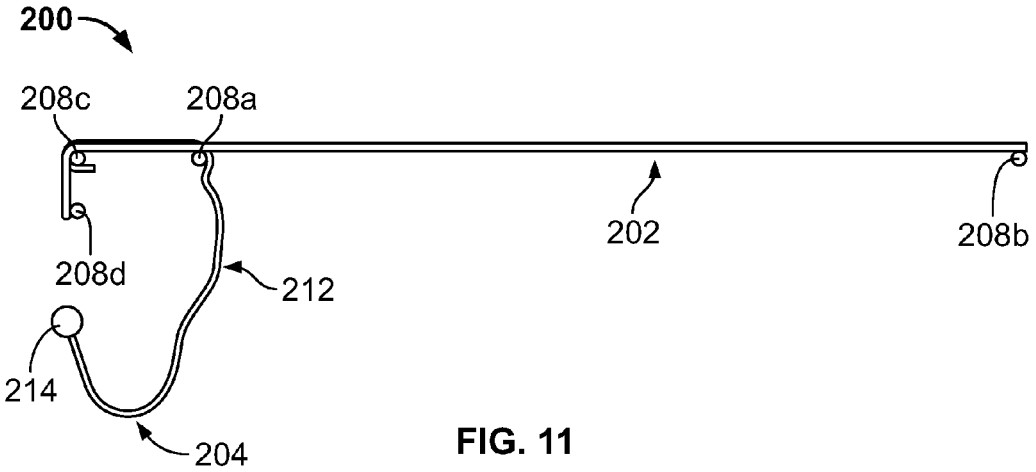
FIG. 11 is a side elevation view of the shelving unit of FIG. 8, illustrating the hanger assembly installed to the wire shelf of the shelving unit.

With reference now to FIGS. 5-7, installation of the hanger assembly 104 to the wire shelf 102 will be described. In the illustrated embodiment, the brackets 112 are positioned generally over wire stringers 106 of the wire shelf 102 when the hanger assembly 104 is installed to the wire shelf 102. This is accomplished utilizing a slot opening or groove 134 defined in the first end portion 116, the upper member 124, the elbow portion 120, and the lip portion 126 of each of the brackets 112. Alternatively, the brackets 112 of the hanger assembly 104 could be positioned simply between adjacent wire stringers 106 of the wire shelf 102 when installing the hanger assembly 104 to the wire shelf 102 within the scope of the present disclosure.

To install the hanger assembly 104 to the wire shelf 102 (as illustrated in FIGS. 5-7), the brackets 112 of the hanger assembly 104 are first positioned below the wire shelf 102 with the slot opening or groove 134 of each of the brackets 112 generally aligned with a wire stringer 106 of the wire shelf 102. The brackets 112 are then raised partly through the wire shelf 102, with the wire stringers 106 received in the slot openings or grooves 134. A portion of each of the brackets 112 (e.g., including the first end portion 116, the upper member 124, and the elbow portion 120, etc.) is then positioned generally above forward and rearward support members 108*a*, 108*b* of the wire shelf 102. Next, the first end portion 116 of each of the brackets 112 is positioned such that the forward support member 108*a* is received within the channel 122 of the first end portion 116. And, the brackets 112 are then rotated downwardly (generally pivoting about the forward support member 108*a*) until the lip portion 126 of each of the brackets 112 engages the rearward support member 108*b* (FIGS. 5 and 6).

At this point, it should be appreciated that the forward and rearward support members 108*a*, 108*b* of the wire shelf 102 are spaced apart a distance generally corresponding to a distance between the first end portion 116 and the elbow portion 120 of each of the brackets 112. But a distance between the first end portion 116 and the lip portion 126 of each of the brackets 112 is less than a distance between the first end portion 116 and the elbow portion 120. As such, the lip portion 126 of each of the brackets 112 initially resists movement of the rearward support member 108*b* into the elbow portion 120 of each of the brackets 112. But the brackets 112 are resiliently flexible such that a further force can be applied to the brackets 112 pulling (or pushing) them downwardly, causing them to flex and thereby allow movement of the rearward support member 108*b* past the lip portion 126 and into the elbow portion 120 of each of the brackets 112 (FIG. 7). This resilient nature of the brackets 112 then also repositions the lip portion 126 of each of the brackets 112 generally under the rearward support member 108*b* to help maintain the coupling of the brackets 112 to the support members 108*a*, 108*b* (and help retain the rearward support member 108*b* within the bend of the elbow portion 120 of each of the brackets 112). As such, in the illustrated embodiment a snap-fit (or interference) engagement fit is provided between the brackets 112 and the support members 108*a*, 108*b* of the wire shelf 102. What's more, the brackets 112 can be removed from the support members 108*a*, 108*b* in a similar fashion as desired. Other types of engagement fits (e.g., other than snap-fit engagement fits, etc.) may be used in other example embodiments (e.g., hanging engagement fits, gravity engagement fits, etc.).

As can be seen (FIG. 4), the brackets 112 of the hanger assembly 104 each have a border (e.g., extending from the first end portion 116 to the second end portion 118, etc.) that generally defines a common interior region 136 for receiving both the forward and the rearward support members 108*a*, 108*b* of the wire shelf 102 therein when the hanger assembly 104 is coupled to the wire shelf 102.

FIGS. 8-11 illustrate another example embodiment of a shelving unit 200 including one or more aspects of the present disclosure. The shelving unit 200 is substantially similar to the shelving unit 100 previously described and illustrated in FIGS. 1-7. For example, the shelving unit 200 generally includes a wire shelf 202 and a hanger assembly 204 (having brackets 212 and a rod 214) configured to couple thereto. In this embodiment, however, the wire shelf 202 includes a different arrangement of support members 208*a-d*. As such, when the hanger assembly 204 is coupled to the support members 208*a*, 208*c*, it is located generally further forward of the wire shelf 202 than in the shelving unit 100 illustrated in FIGS. 1-7 (however, both could still have similar hangs (e.g., a twelve-inch hang, etc.).

Figure 12:
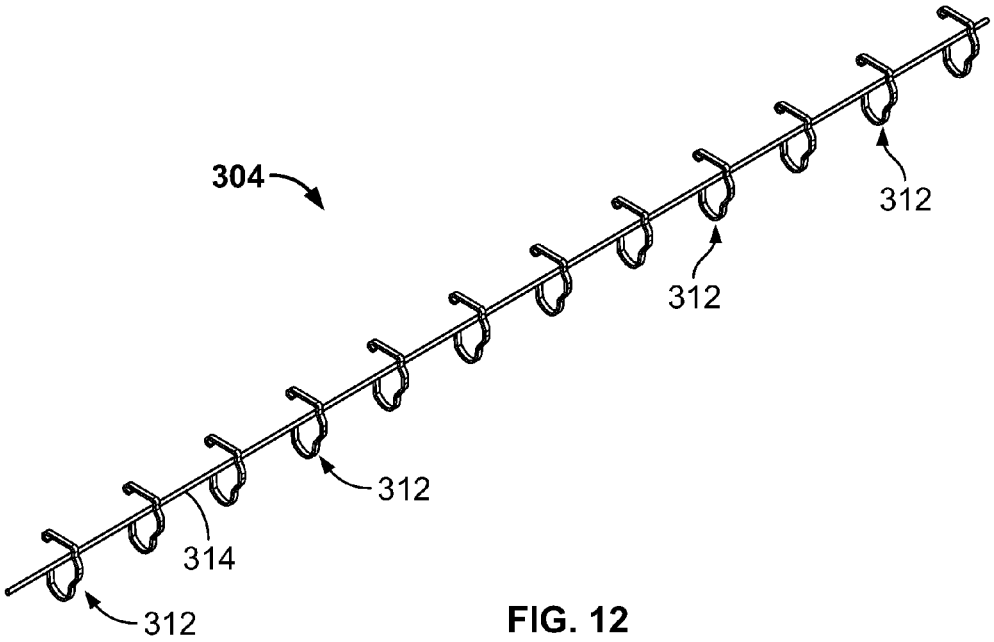
FIG. 12 is a perspective view of a hanger assembly according to another example embodiment of the present disclosure.
Figure 13:
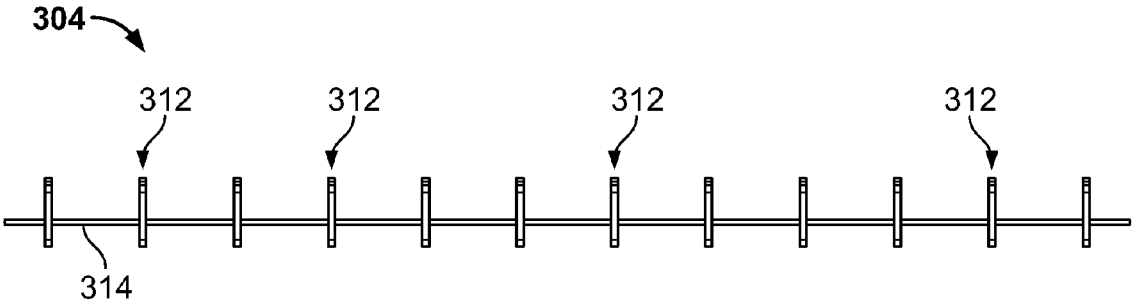
FIG. 13 is a front elevation view of the hanger assembly of FIG. 12.

FIGS. 12 and 13 illustrate an example embodiment of a hanger assembly 304 suitable for use with shelving units (e.g., shelving units 100, 200, etc.) of the present disclosure (and for coupling to wire shelves (e.g., wire shelves 102, 202, etc.) of the present disclosure). The hanger assembly 304 includes multiple brackets 312, and a rod 314 coupled to each of the brackets 312. In particular, the illustrated hanger assembly 304 includes twelve brackets 312. But other example embodiments may have hanger assemblies including more than or fewer than twelve brackets. Other aspects of the hanger assembly 304 of this embodiment are substantially similar to those of the hanger assembly 104 previously described with reference to FIGS. 1-7.

Figure 14:
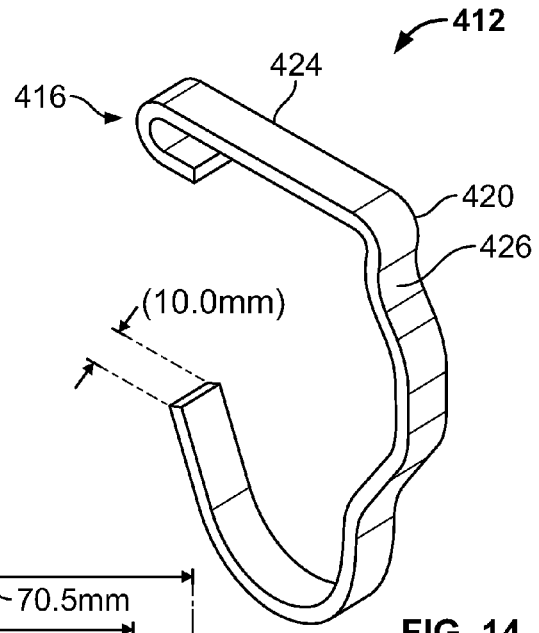
FIG. 14 is a perspective view of a bracket according to another example embodiment of the present disclosure with dimensions provided for purpose of illustration only.
Figure 15:
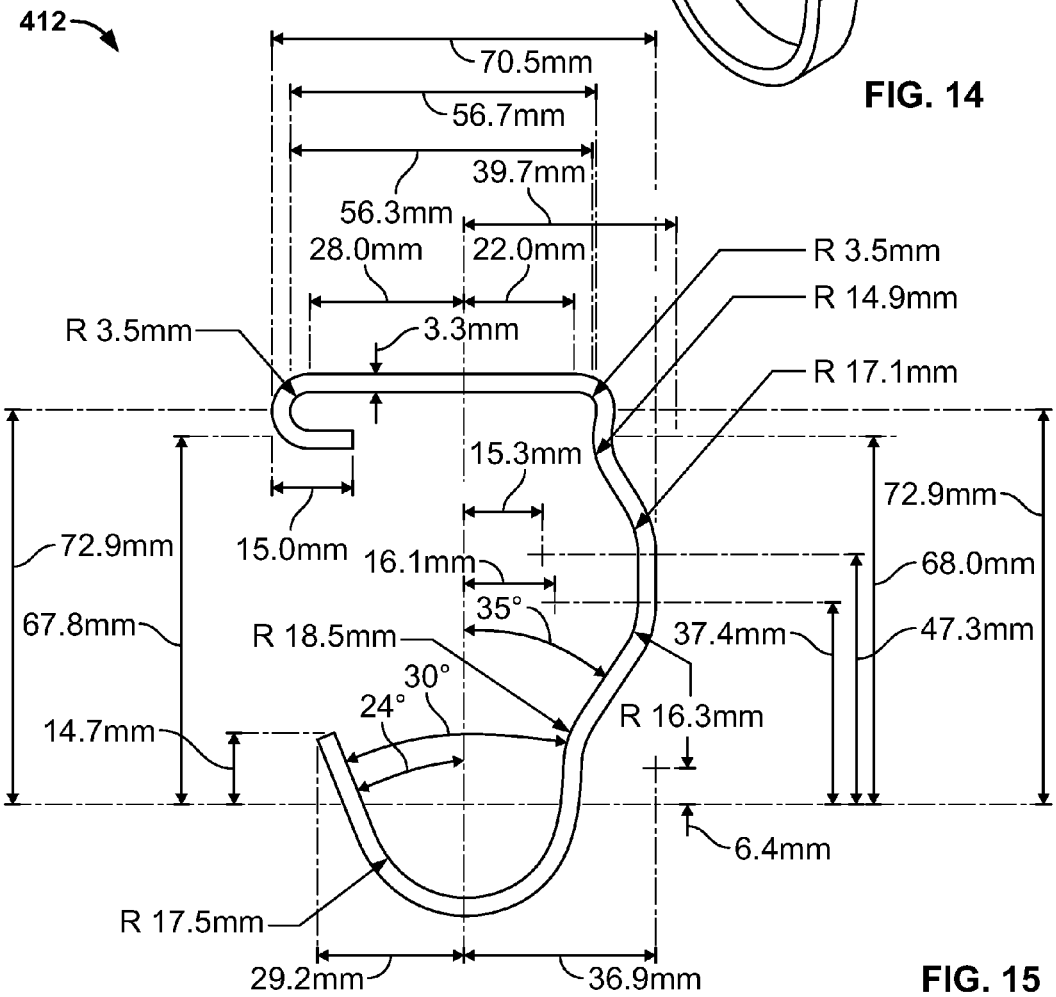
FIG. 15 is a side elevation view of the bracket of FIG. 14 with dimensions provided for purpose of illustration only.

FIGS. 14 and 15 illustrate an example embodiment of a bracket 412 suitable for use, for example, with a hanger assembly (e.g., hanger assembly 104, 204, 304, etc.) of the present disclosure (and thereby suitable for use with shelving units (e.g., shelving units 100, 200, etc.) of the present disclosure for coupling to wire shelves (e.g., wire shelves 102, 202, etc.)). In this embodiment, example dimensions are provided for the bracket 412. However, it should be appreciated that the dimensions are only exemplary in nature and do not limit the scope of the present disclosure. In addition in this embodiment, the bracket 412 does not include a slot opening or groove (e.g., a slot opening or groove is not defined in a first end portion 416, an upper member 424, an elbow portion 420, a lip portion 426, etc. of the bracket 412). As such, the bracket 412 is configured to be positioned between adjacent wire stringers of a wire shelf when installing a hanger assembly including the bracket 412 to a wire shelf. With that said, other aspects of the bracket 412 of this embodiment are substantially similar to those of the bracket 112 previously described with reference to FIGS. 1-7.

Figure 16:
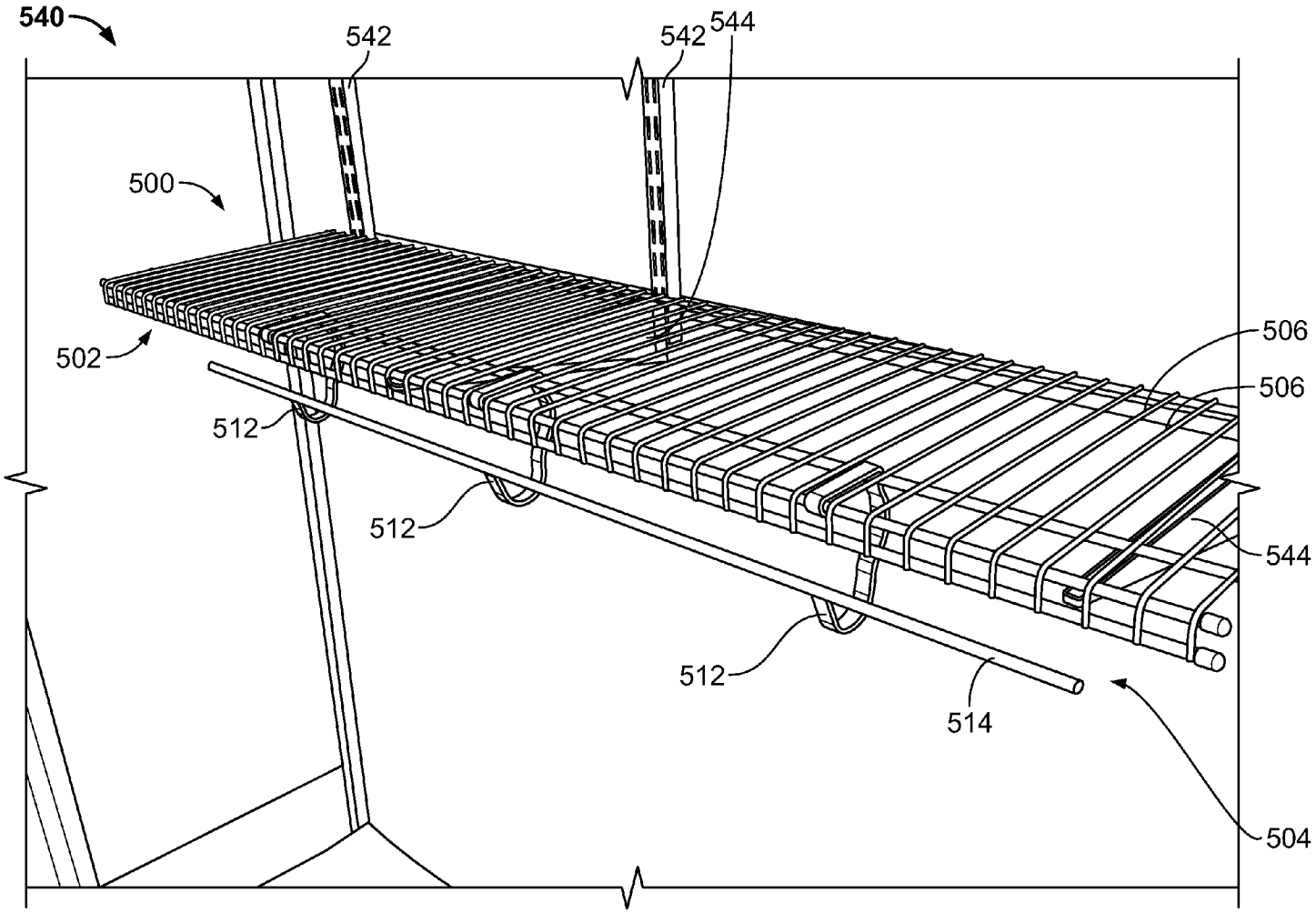
FIG. 16 is a fragmentary perspective view of a storage system according to an example embodiment of the present disclosure.

FIGS. 16 and 17 illustrate an example embodiment of a storage system 540 incorporating a shelving unit 500 having one or more aspects of the present disclosure. The illustrated storage system 540 generally includes the shelving unit 500, having a wire shelf 502 and a hanger assembly 504. Multiple standards 542 and mounts 544 (coupled to the wire shelf 502 and configured to couple to the standards 542) are also provided for use in supporting, suspending, etc. the shelving unit 500 (FIG. 16) (e.g., from a wall, etc.). Additional supports (e.g., posts, wall mounts, etc.) may be used to further support the shelving unit 500 (e.g., to support the wire shelf 502, a rod 514, etc. of the shelving unit) as desired.

The hanger assembly 504 of the storage system 540 includes brackets 512 and the rod 514. And, the rod 514 is shown welded to the bracket 512 (see, FIG. 17). The illustrated hanger assembly 504 is shown with three brackets 512, but could include any desired number of brackets 512 within the scope of the present disclosure. Also in this embodiment, the brackets 512 of the hanger assembly 504 do not include slot openings or grooves (e.g., a slot opening or groove is not defined in a first end portion 516, an upper member 524, an elbow portion 520, a lip portion 526, etc. of any of the brackets 512). As such, the illustrated brackets 512 are configured to be positioned between adjacent wire stringers 506 of the wire shelf 502 (FIG. 16) when the hanger assembly 504 is installed to the wire shelf 502. Other aspects of the hanger assembly 504 of this embodiment are substantially similar to those of the hanger assembly 104 previously described with reference to FIGS. 1-7.

Figure 18A:
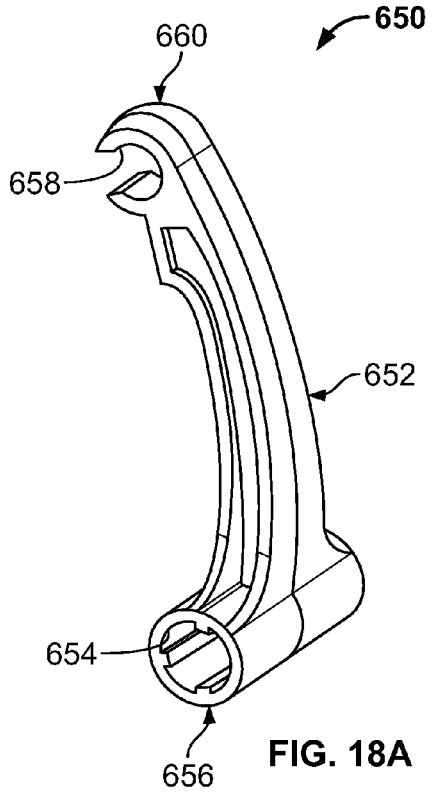
FIG. 18A is a perspective view of a stop according to an example embodiment of the present disclosure and configured for use with shelving units of the present disclosure.
Figure 18B:
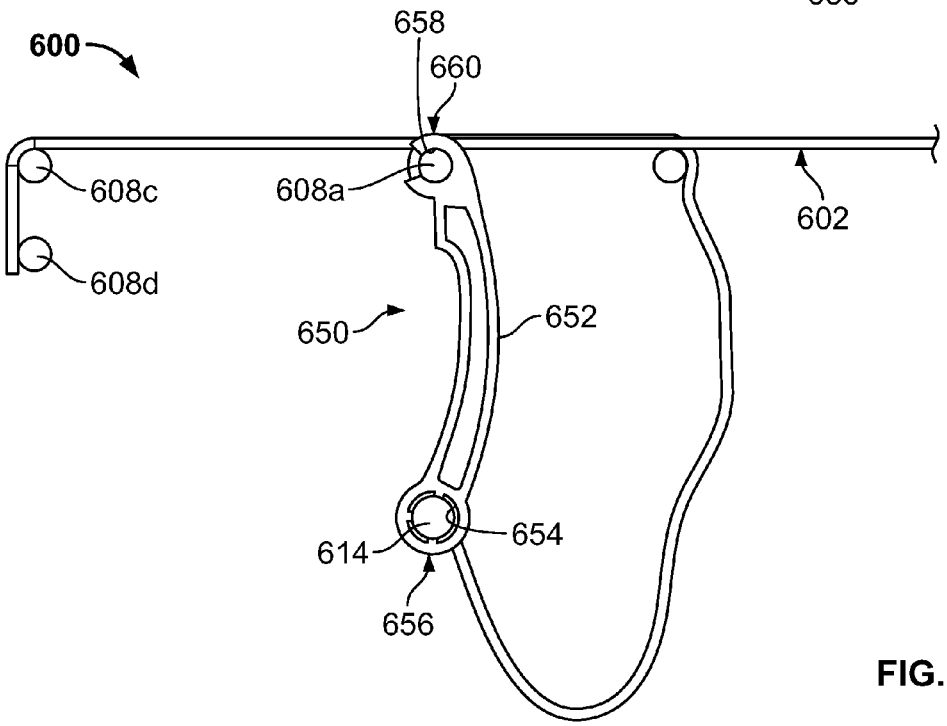
FIG. 18B is a side elevation view of the stop of FIG. 18A installed in a shelving unit of the present disclosure.

FIGS. 18A and 18B illustrate an example embodiment of a stop 650 for use with a shelving unit 600 of the present disclosure. The stop 650 is configured for installation to a rod 614 of the shelving unit 600, for example, to thereby inhibit movement of hangers along the rod 614 and past the stop 650. For example, the stop 650 can be positioned toward an end portion of the rod 614 to thereby inhibit hangers from sliding off the rod 614 (e.g., to terminate the rod 614 a desired location under the shelving unit 600, etc.), to separate the rod 614 from an adjacent rod (of an adjacent hanger assembly), to help couple end portions of adjacent rods together (e.g., to help make efficient use of rod materials and avoid scrap rod materials, etc.), to terminate the rod 614 at a location prior to termination of a wire shelf 602 (e.g., such that the wire shelf 602 can extend past the end of the rod 614, etc.), etc. The stop 650 can be formed from any suitable material (e.g., plastic, metal, combinations thereof, etc.) within the scope of the present disclosure.

The illustrated stop 650 includes a body 652 having an opening 654 extending through a first end portion 656 (e.g., a lower end portion as viewed in FIG. 18, etc.), and a channel 658 defined in a second end portion 660 (e.g., an upper end portion as viewed in FIG. 18, etc.). The opening includes ridges, teeth, etc. to help position the rod 614 in the opening 654, and a stop to help limit the length the rod 614 can be positioned into the opening 654 (e.g., such that the rod 614 can only be positioned up to about a longitudinal center of the stop 650, etc.). In an example use, the opening 654 of the first end portion 656 is positioned over (e.g., slid over, etc.) an end portion of the rod 614 of the shelving unit 600. And, the channel 658 of the second end portion 660 is positioned over (e.g., rested on, press-fit onto, snap-fit onto, etc.) a support member 608*a* of the wire shelf 602, for example, generally between stringers, etc. of the wire shelf 602 and at a location generally above the rod 614. If a second rod (e.g., from a second shelving unit, etc.) is desired to be coupled to the stop 650 (e.g., to thereby couple the rods of the two shelving units together, etc.), the second rod can then be positioned in the opening 654 of the first end portion 656 of the stop 650 on an opposite side of the stop 650 from where the rod 614 is located. In addition, it should be appreciated that the stop 650 can be oriented in the shelving unit 600 as illustrated in FIG. 18B (with the convex portion of the body 652 of the stop 650 facing toward the right (e.g., toward the back of the shelving unit 600, etc.) as viewed in FIG. 18B), or the stop 650 could be reversed, rotated, etc. (e.g., one-hundred eighty degrees about a longitudinal axis of the stop 650, etc.) such that the rod 614 would be positioned in the opening 654 of the first end portion 656 of the stop 650 on the opposite side of the stop 650 (and such that the convex portion of the body 652 of the stop 650 would be facing toward the left (e.g., toward the front of the shelving unit 600, etc.) as viewed in FIG. 18B). Further, it should also be appreciated that the stop 650 could be installed to the shelving unit 600 with the opening 654 of the first end portion 656 positioned over the rod 614 of the shelving unit 600, and the channel 658 of the second end portion 660 positioned over one of the forward support members 608*c* or 608*d* of the wire shelf 602.

It should also be appreciated that the stop 650 could be used with one or more other shelving units of the present disclosure, or with other desired shelving units. For example, the stop 650 could be installed in the shelving unit 200 illustrated in FIGS. 8-11. Here, in an example installation, the opening 654 of the first end portion 656 of the stop 650 would be positioned over (e.g., slid over, etc.) an end portion of a rod 214 of the shelving unit 200. And, the channel 658 of the second end portion 660 would be positioned over (e.g., rested on, press-fit onto, snap-fit onto, etc.) the support member 208*d* of the wire shelf 202 of the shelving unit 200, for example, generally between stringers, etc. of the wire shelf 202 and at a location generally above the rod 214.

In other example embodiments, stops may be formed with channels defined in first and second end portions. The channels allow first end portions of the stops to be positioned over rods of shelving units, and second end portions of the stops to be positioned over support members of wire shelves of the shelving units, for example, generally between stringers, etc. of the wire shelves. Having channels defined in both the first and second end portions allows the stops to be easily positioned along the rods at locations between brackets of the shelving units such that the stops can be positioned at any location along the rods.

In other example embodiments, stops may be formed with slot openings or grooves in second end portions (generally transverse to channels defined in the second end portions) to accommodate, as necessary, stringers of wire shelves when the stops are installed thereto. This would allow the stops to be positioned along rods generally in line with the stringers of the shelves, with the slot openings or grooves then receiving the stringers therein when the stops are installed to support members of the wire shelves.

In one example embodiment, a stop of the present disclosure has the following dimensions. A height of the stop is about 69.5 millimeters. A width of a first end portion of the stop is about 25.4 millimeters, and a width of a second end portion of the stop is about 10.2 millimeters. These dimensions are exemplary in nature and do not limit the scope of the present disclosure.

Figure 19:
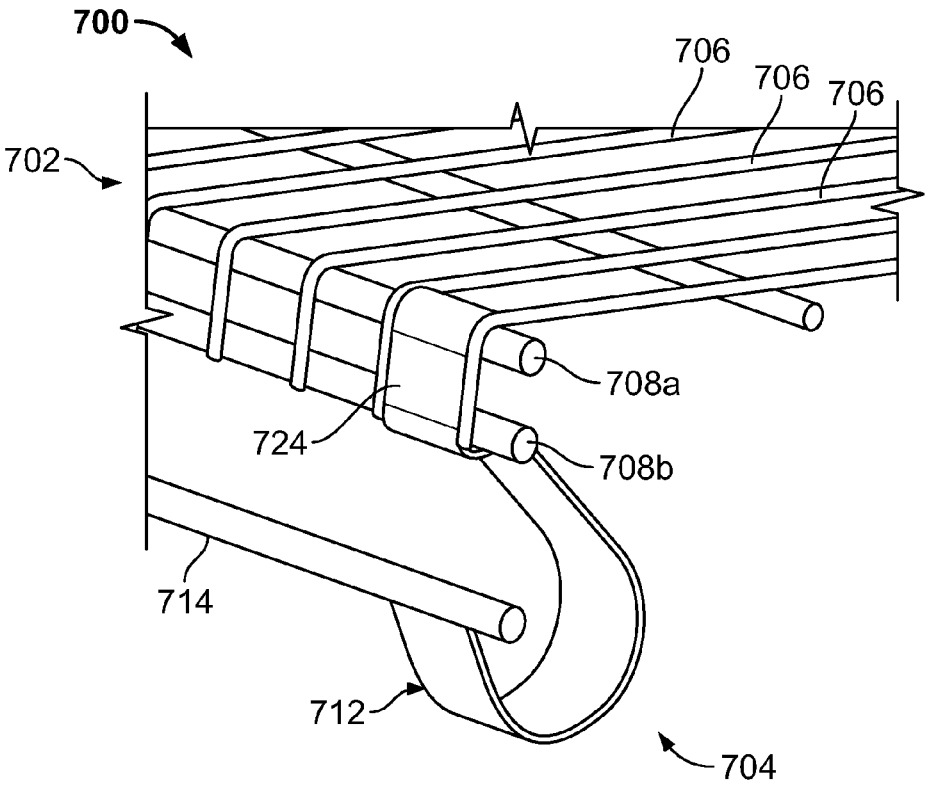
FIG. 19 is a perspective view of a shelving unit according to another example embodiment of the present disclosure.

FIGS. 19-22 illustrate another example embodiment of a shelving unit 700 including one or more aspects of the present disclosure. As shown in FIG. 19, the shelving unit 700 generally includes a wire shelf 702 and a hanger assembly 704 configured to couple thereto.

The wire shelf 702 of the illustrated shelving unit 700 generally includes multiple wire members arranged to form a platform (e.g., for stacking, storing, etc. items). The wire members include multiple wire stringers 706, and multiple support members 708*a*, 708*b* arranged generally transverse to the wire stringers 706 for providing support to the wire stringers 706. The wire stringers 706 are spaced to provide a ventilated structure for the wire shelf 702 while preventing relatively large items stored on the wire shelf 702 from passing between spaces between the wire members.

Figure 20:
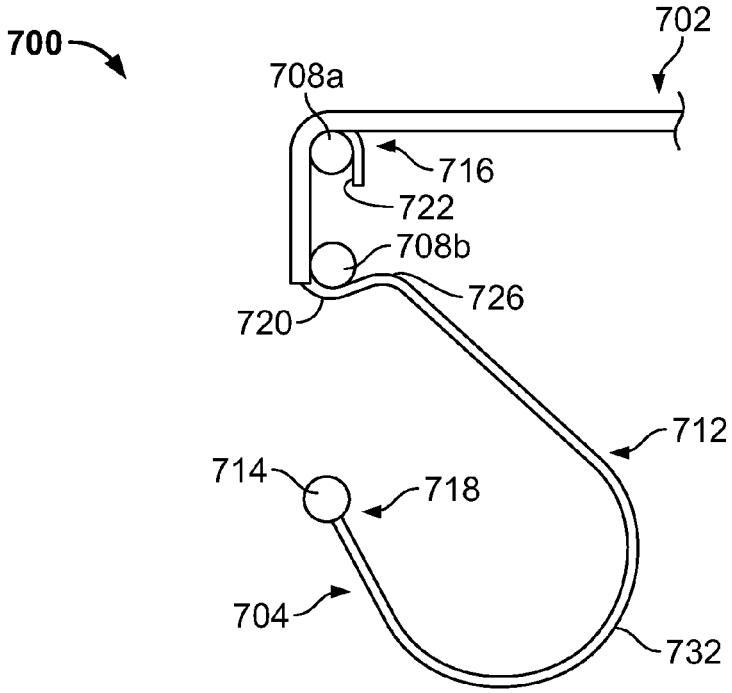
FIG. 20 is a side elevation view of the shelving unit of FIG. 19.

With additional reference to FIG. 20, the hanger assembly 704 of the illustrated shelving unit 700 includes a bracket 712 for use in coupling (e.g., releasably coupling, etc.) the hanger assembly 704 to the wire shelf 702. A rod 714 is coupled (e.g., releasably coupled, fixedly coupled (e.g., welded as shown in FIG. 16, etc.), etc.) to the bracket 712 for accommodating hanging items from the hanger assembly 704, for example, to allow a clothes hanger to slide along the rod 714 freely past the bracket 712 without interference therefrom. It should be appreciated that any desired number of brackets may be used with the hanger assembly 704, and/or that any desired length of rod may be used within the scope of the present disclosure.

The bracket 712 is defined by a generally flat piece of material having generally uniform thickness along an entire length of the bracket 712. As shown in FIG. 20, the bracket 712 generally includes first and second end portions 716, 718, and an elbow portion 720. The first end portion 716 is generally hook-shaped and defines a channel 722 that opens toward a lower portion of the bracket 712 (generally downwardly in FIG. 20) (and generally toward the elbow portion 720). A generally straight side member 724 extends between the first end portion 716 and the elbow portion 720. A rounded lip portion 726 is located generally adjacent the elbow portion 720 and protrudes generally toward the first end portion 716 of the bracket 712 (generally upwardly in FIG. 20). As such, the elbow portion 720 defines a generally rounded bend having a radial angle that is slightly greater than about ninety degrees. The bracket 712 further includes a generally U-shaped portion 732 leading from the lip portion 726 to the second end portion 718 (where the rod 714 is then coupled to the bracket 712).

Figure 21:
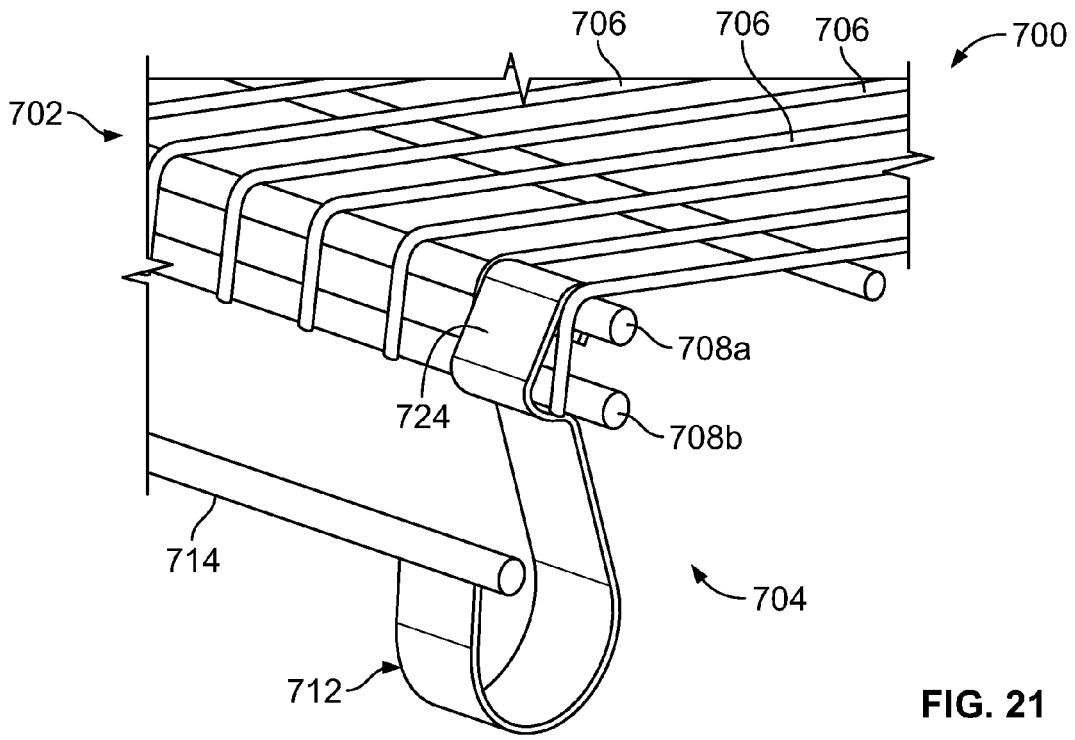
FIG. 21 is another perspective view of the shelving unit of FIG. 19, illustrating installation of a hanger assembly of the shelving unit to a wire shelf of the shelving unit.
Figure 22:
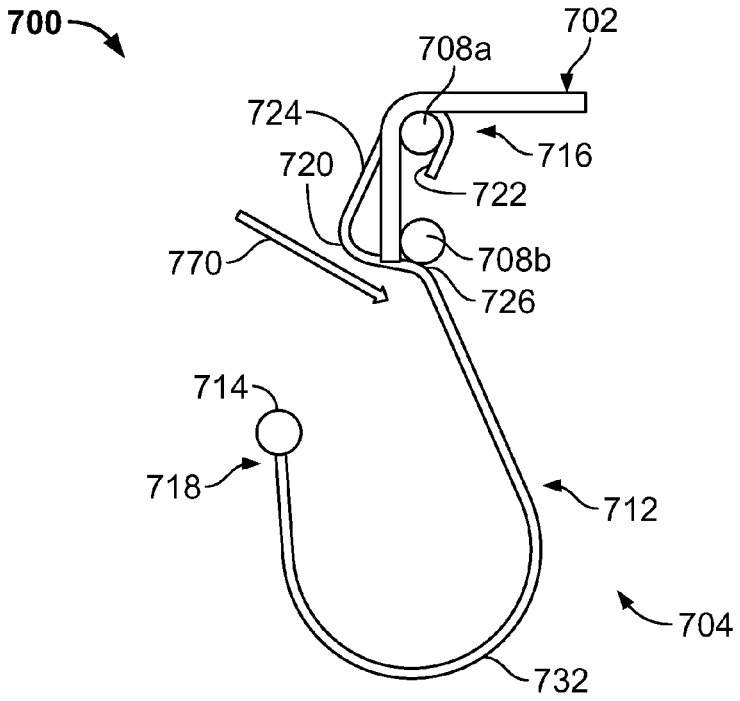
FIG. 22 is a side elevation view of the shelving unit of FIG. 21, illustrating the installation of the hanger assembly to the wire shelf of the shelving unit.

With additional reference now to FIGS. 21 and 22, installation of the hanger assembly 704 to the wire shelf 702 will be described. In the illustrated embodiment, the bracket 712 is positioned generally between wire stringers 706 of the wire shelf 702 when the hanger assembly 704 is installed to the wire shelf 702 (FIG. 20). To install the hanger assembly 704 to the wire shelf 702, the hanger assembly 704 is first positioned generally forward of the wire shelf 702, with the first end portion of the bracket 712 positioned generally above upper and lower support members 708*a*, 708*b* of the wire shelf 702. Next, the first end portion 716 of the bracket 712 is positioned such that the upper support member 708*a* is received within the channel 722 of the first end portion 716. The bracket 712 is then rotated downwardly (generally counterclockwise as viewed in FIG. 22, and pivoted about the upper support member 708*a*) until the lip portion 726 of the bracket 712 engages the lower support member 708*b* (FIGS. 21 and 22).

It should be appreciated that the upper and lower support members 708*a*, 708*b* of the wire shelf 702 are spaced apart a distance generally corresponding to a distance between the first end portion 716 and the elbow portion 720 of the bracket 712. But a distance between the first end portion 716 and the lip portion 726 is less than a distance between the first end portion 716 and the elbow portion 720. As such, the lip portion 726 of the bracket 712 initially resists movement of the lower support member 708*b* into the elbow portion 720 of the bracket 712. But the bracket 712 is resiliently flexible such that a further force (as indicated by arrow 770 in FIG. 22) can be applied to the bracket 712 pulling (or pushing) it generally rearwardly of the wire shelf 702, causing it to flex and thereby allow movement of the lower support member 708*b* past the lip portion 726 and into the elbow portion 720 of the bracket 712 (FIGS. 19 and 20). This resilient nature of the bracket 712 then also repositions the lip portion 726 partially behind the lower support member 708*b* to help maintain the coupling of the bracket 712 to the support members 708*a*, 708*b* (and help retain the lower support member 708*b* within the bend of the elbow portion 720 of the bracket 712). As such, a snap-fit (or interference) engagement is provided between the bracket 712 and the support members 708*a*, 708*b* of the wire shelf 702.

Figure 24:
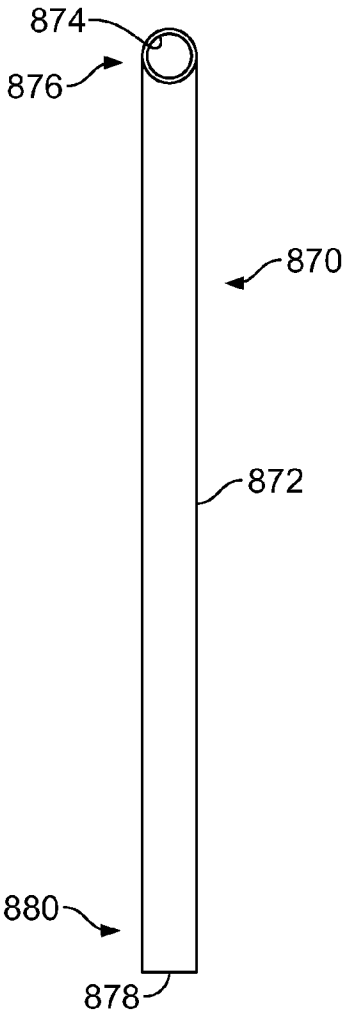
FIG. 24 is a side elevation view of the corner connector of FIG. 23.
Figure 23:
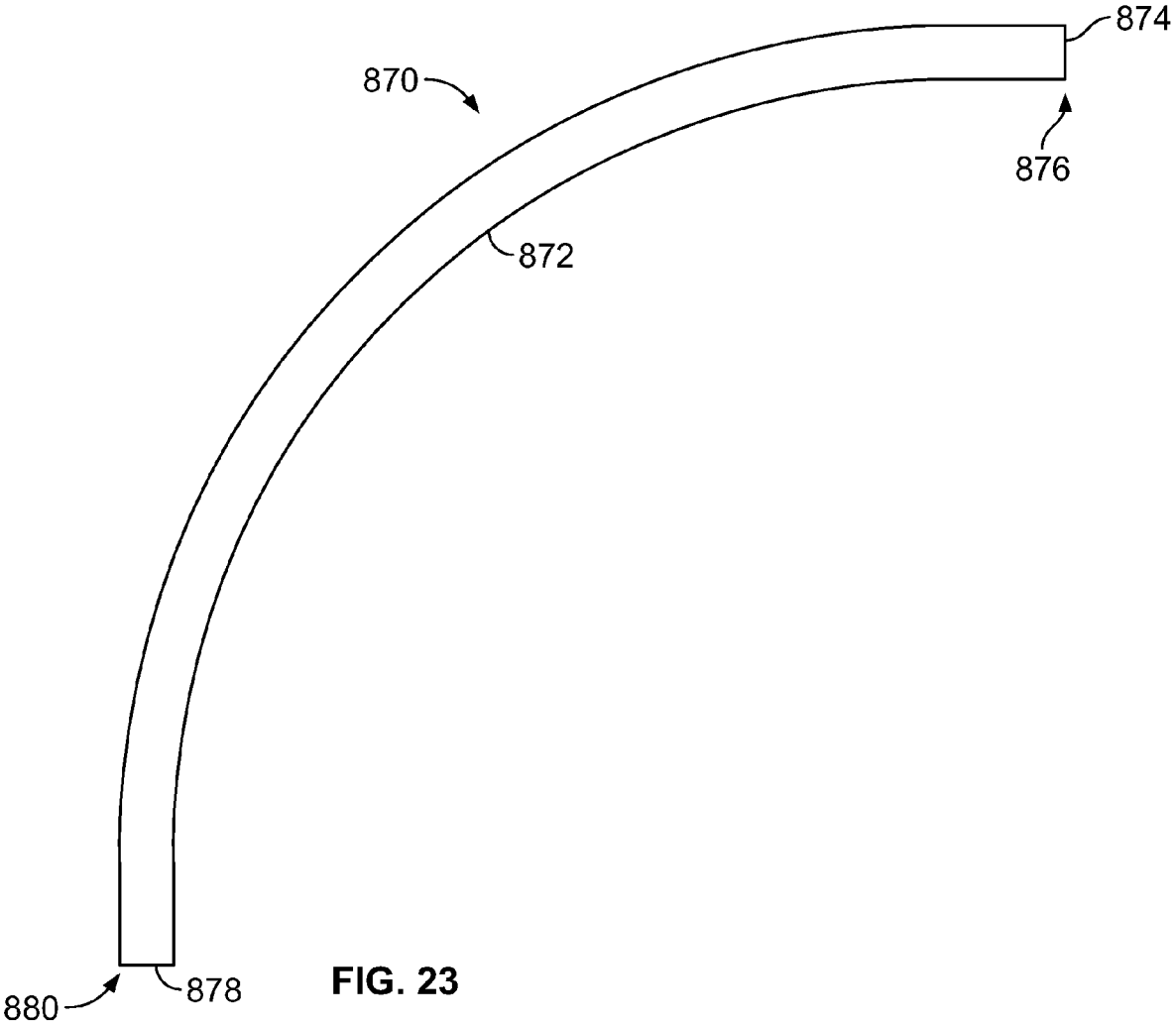
FIG. 23 is an upper plan view of a corner connector according to an example embodiment of the present disclosure and configured for use with shelving units of the present disclosure.
Figure 25:
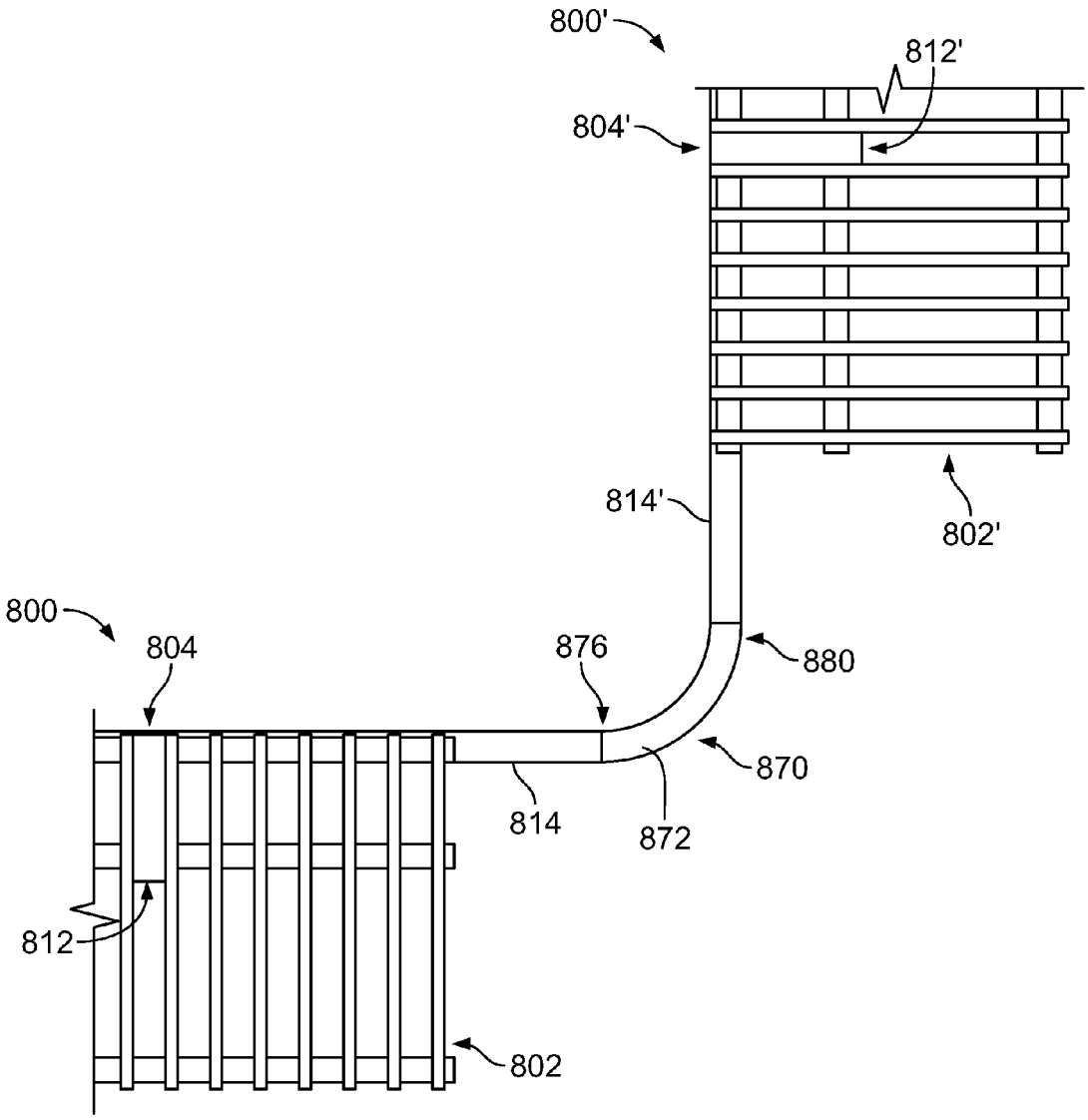
FIG. 25 is an upper plan view of the corner connector of FIG. 23 shown installed to shelving units of the present disclosure.

FIGS. 23-25 illustrate an example embodiment of a corner connector 870 for use with shelving units 800, 800' of the present disclosure. The shelving units 800, 800' are each substantially similar to the shelving unit 200 previously described and illustrated in FIGS. 8-11. For example, the shelving units 800, 800' generally include wire shelves 802, 802' and hanger assemblies 804, 804' configured to couple thereto via brackets 812, 812'. And, the corner connector 870 is configured for installation to rods 814, 814' of the hanger assemblies 804, 804', for example, to thereby allow continuous movement of hangers along the rods 814, 814' between the shelving units 800, 800'. In particular, the corner connector 870 can be installed to adjacent end portions of the rods 814, 814' to thereby allow for the continuous movement of the hangers between the rods 814, 814'. With that said, it should be appreciated that the corner connector 870 could alternatively be used with any of the other shelving units (e.g., shelving units 100, 500, 600, 700, etc.) of the present disclosure or, further, with any other desired shelving units, for example, having adjacently positioned rods, etc. The corner connector 870 can also be used in shelving units in conjunction with the stop 650 illustrated in FIGS. 18A and 18B as desired.

As shown in FIGS. 23 and 24, the illustrated corner connector 870 includes a curved body 872 having an opening 874 at a first end portion 876, and an opening 878 at a second end portion 880. In some aspects, the corner connector 870 may be defined by a generally hollow tube structure, with a channel extending through the body 872 of the corner connector 870 and thereby defining the openings 874, 878 at the first and second end portions 876, 880. In other aspects, the corner connector 870 may be defined by a generally solid structure, with the openings 874, 878 then formed at the first and second end portions 876, 880. With that said, the corner connector 870 can be formed from any suitable material (e.g., plastic, metal, combinations thereof, etc.) within the scope of the present disclosure. In addition, the corner connector 870 may also be epoxy coated within the scope of the present disclosure to provide smooth surfaces (and low sliding friction).

In an example use (FIG. 25), the corner connector 870 is installed to end portions of the rods 814, 814' of the adjacent shelving units 800, 800' (e.g., with the shelving units 800, 800' positioned at different orientations within a closet as shown in FIG. 25, etc.). The opening 874 of the first end portion 876 is positioned over (e.g., slid over, etc.) an end portion of the rod 814 of the shelving unit 800. And, the opening 878 of the second end portion 880 is positioned over (e.g., slid over, etc.) an end portion of the rod 814' of the shelving unit 800'. As such, the corner connector 870 can provide a transition (e.g., a radius transition, etc.) between the hanger assemblies 804, 804' of the shelving units 800, 800' and, thus, an uninterrupted slide path therebetween. For example, hangers can move continuously between the rods 814, 814' of the shelving units 800, 800' across the corner connector 870. In the illustrated embodiment, the curved body 872 of the corner connector 870 defines a radial angle of about ninety-degrees. This allows the corner connector 870 to accommodate the shelving units 800, 800' offset by about ninety-degrees. In other example embodiments, corner connectors may define radial angles other than about ninety-degrees (e.g., radial angles greater than about ninety-degrees; radial angles less than about ninety-degrees, etc.) to thereby accommodate shelving units oriented differently than illustrated herein (e.g., at relative angles other than about ninety-degrees, etc.).

In one example embodiment, a corner connector of the present disclosure has the following dimensions. The corner connector has a body defined by a generally hollow tube structure, where an outer diameter of the body is about 9.6 millimeters and an inner diameter of a channel extending through the body is about 8.0 millimeters. End portions of the body are generally strait, and each extend a length of about 19.7 millimeters. A central portion of the body, extending between the end portions, is curved and defines a radial angle of about ninety-degrees with a radius of about 144.0 millimeters. These dimensions are exemplary in nature and do not limit the scope of the present disclosure.

In some aspects of the present disclosure, shelving units having twelve inch deep wire shelves and shelving units having sixteen inch deep wire shelves can be used together, for example, because rods of the shelving units would align. This is accomplished by positioning the hanger assemblies toward the front portions of the shelving units having the twelve inch deep wire shelves (e.g., as illustrated in shelving unit 200 illustrated in FIGS. 8-11, etc.) so that they have a twelve-inch hang, and positioning the hanger assemblies rearward of the front portions of the shelving units having the sixteen inch deep wire shelves (e.g., as illustrated in the shelving unit 100 illustrated in FIGS. 1-7, etc.) so that they also have a twelve-inch hang.

FIGS. 26A-26D illustrate an example embodiment of a rod joiner 900 (e.g., hang rod joiner, rod expander, rod connector, etc.). The rod joiner 900 may be coupled between two rods to connect the two rods across a gap, spaced distance, etc. For example, two rods may be used in the shelf unit as described herein, with a separation, spaced distance, gap, etc., between the two rods. The rod joiner 900 may be coupled between the separated rods to connect the separated rods together and allow hanging items to slide from one rod to another, hang from the rod joiner, etc.

The rod joiner 900 may be used to couple together any two suitable rods, including, for example, the rods described herein (e.g., rods 114, 214, 314, 514, 614, 714, etc.).

Figure 26A:
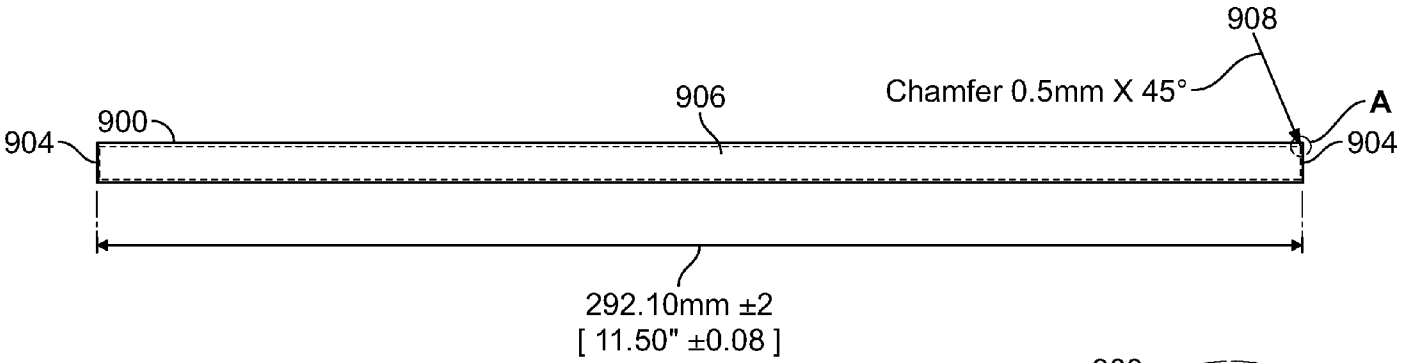
FIG. 26A is a side view of a rod joiner according to another example embodiment of the present disclosure.

The rod joiner 900 is shown in FIG. 26A as having a generally cylindrical shape. FIG. 26B is a perspective view of the rod joiner 900, illustrating its generally cylindrical shape. In other embodiments, the rod joiner may have a different suitable shape (e.g., oval, square, rectangular, hexagonal, etc.). The dimensions illustrated in FIG. 26A (and in any other figures) are for purposes of illustration only, and other embodiments may have other suitable dimensions. For example, the rod joiner 900 may have a length of approximately 11.5 inches in some embodiments.

The rod joiner 900 has openings 902 at each end 904 of the rod joiner 900. A side view of an opening 902 is illustrated in FIG. 26D. The openings 902 at each end may be substantially identical in some embodiments. Dimensions of the inner diameter of the opening 902 and the outer diameter of the rod joiner end 904 are shown for illustration purposes only, and other embodiments may have other suitable dimensions. For example, the rod opening 902 may have an inner diameter of approximately 8.0 millimeters, and the rod joiner may have an outer diameter of approximately 9.6 millimeters in some embodiments.

The inner diameter of the opening 902 may correspond to an outer diameter of a rod coupled to the end 904 of the rod joiner 900. For example, an end of a rod may be inserted into the opening 902 at the end 904 of the rod joiner 900 to couple the rod and the rod joiner. The end 904 and opening 902 of the rod joiner 900 may be placed over the end of the rod to couple the rod to the rod joiner 900, etc. Accordingly, the rod joiner 900 may couple to a rod via a friction fit, an interference fit, a compression fit, etc. and inhibit removal of the rod from the opening 902 of the rod joiner 900.

As shown in dotted lines in FIG. 26A, the rod joiner 900 may be a hollow cylindrical rod. The rod joiner 900 may have a central channel 906 extending between the openings at each end 904.

Figure 26C:
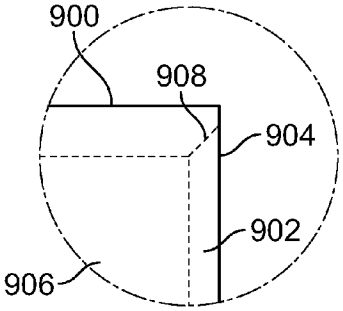
FIG. 26C is a detail view of the portion designated A in FIG. 26A and illustrating a chamfered inner opening of the end of the rod joiner.
Figure 26B:
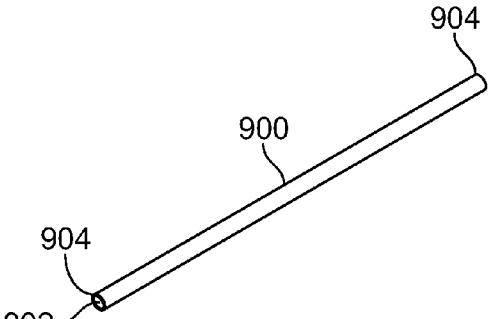
FIG. 26B is a perspective view of the rod joiner of FIG. 26A.
Figure 26D:
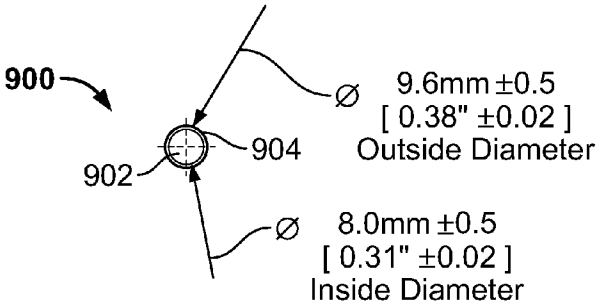
FIG. 26D is front view of the rod joiner of FIG. 26A illustrating an opening of the rod joiner.

As shown in FIG. 26C (and FIG. 26A), the opening 902 of the rod joiner 900 may include a chamfered interior edge 908. The chamfered interior edge 908 may provide for an enhanced friction, compression, etc., fit between the rod joiner 900 and a rod coupled to the rod joiner 900, may guide a rod inserted into the opening 902 of the rod joiner 900, may maintain a fixed depth of insertion of a rod into the opening 902 of the rod joiner 900, etc. The dimensions in FIG. 26A are for purposes of illustration only, and other embodiments may include chamfered edges having different angles, different lengths, no chamfer, etc. As shown in FIG. 26A, some openings 902 may include a 45 degree angle chamfer of approximately 0.5 millimeters.

The rod joiner 900 may provide a separation distance between adjacent rods coupled by the rod joiner 900 that is substantially equal to the length of the rod joiner 900. For example, a first rod may be inserted into a first end 904 of the rod joiner 900 and a second rod may be inserted into a second end 904 of the rod joiner. The rod joiner 900 may not allow the first and second rods to be inserted beyond the openings 902 at each end 904 of the rod joiner 900. Accordingly, the ends of the first and second rods may be separated by approximately the length of the rod joiner 900.

The rod joiner may be made out of any suitable material (e.g., metal, plastic, etc.), which may be the same and/or different from material used for other rods joined by the rod joiner 900, wire shelves, brackets, etc. The rod joiner 900 may be coated with any suitable coating (e.g., paint, protective sealant, etc.).

The rod joiner may provide one or more (but not necessarily any or all) of the following advantages, including, for example, providing a connection for rods that have a gap between them, providing a connection for rods that are fixed to brackets and/or shelves and cannot be moved to contact each other, providing an extension allowing for more hanging items to be stored on a hang rod, allowing items to slide from one rod to another along the rod joiner, etc.

FIGS. 27-30 illustrate a saddle 1000 (e.g., claw, etc.) according to an example embodiment of the present disclosure. The saddle 1000 may be coupled to a bracket to support a rod in the saddle 1000. For example, the saddle 1000 may be configured to couple to any suitable bracket, including the brackets described herein (e.g., bracket 112, 212, 312, 412, 512, 712, etc.), and may be configured to releasably couple and/or support any suitable rod including the rods described herein (e.g., rods 114, 214, 314, 514, 614, 714, etc.).

The saddle 1000 includes an upper saddle portion 1002 and a lower saddle portion 1004. The upper saddle portion 1002 and the lower saddle portion 1004 may be integral with one another, as shown in FIG. 27.

The upper saddle portion 1002 may releasably couple to a rod by receiving the rod in the upper saddle portion 1002, supporting the rod in the upper saddle portion 1002, etc.

The upper saddle portion 1002 may define a channel 1008. The channel 1008 may receive, support, etc., the rod when the rod is coupled to the saddle 1000. The channel 1008 may have an axial direction that is substantially parallel to the rod, such that the rod extends along the axial direction of the channel 1008 when the rod is coupled to the saddle 1000.

Figure 27:
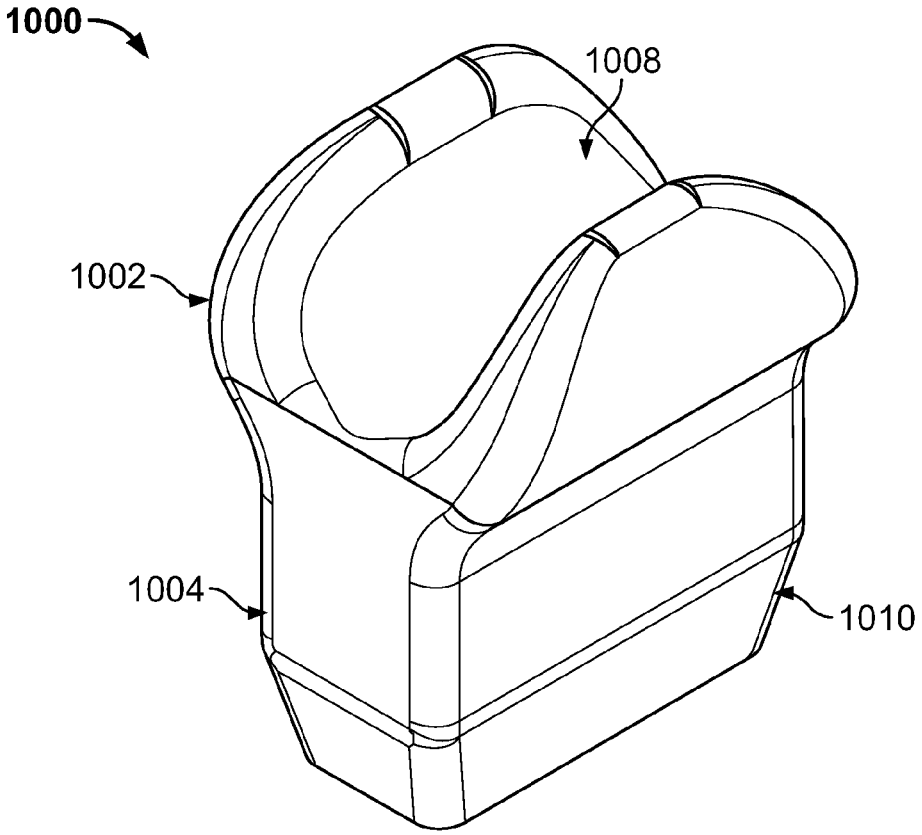
FIG. 27 is a perspective view of a hang rod saddle according to another example embodiment of the present disclosure.
Figure 29A:
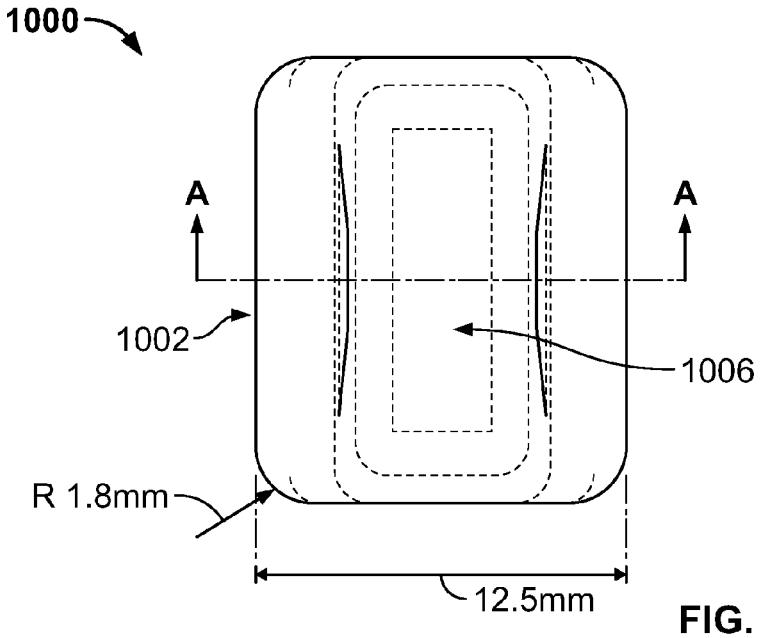
FIG. 29A is a top view of the hang rod saddle of FIG. 27 with dimensions provided for purpose of illustration only.
Figure 29B:
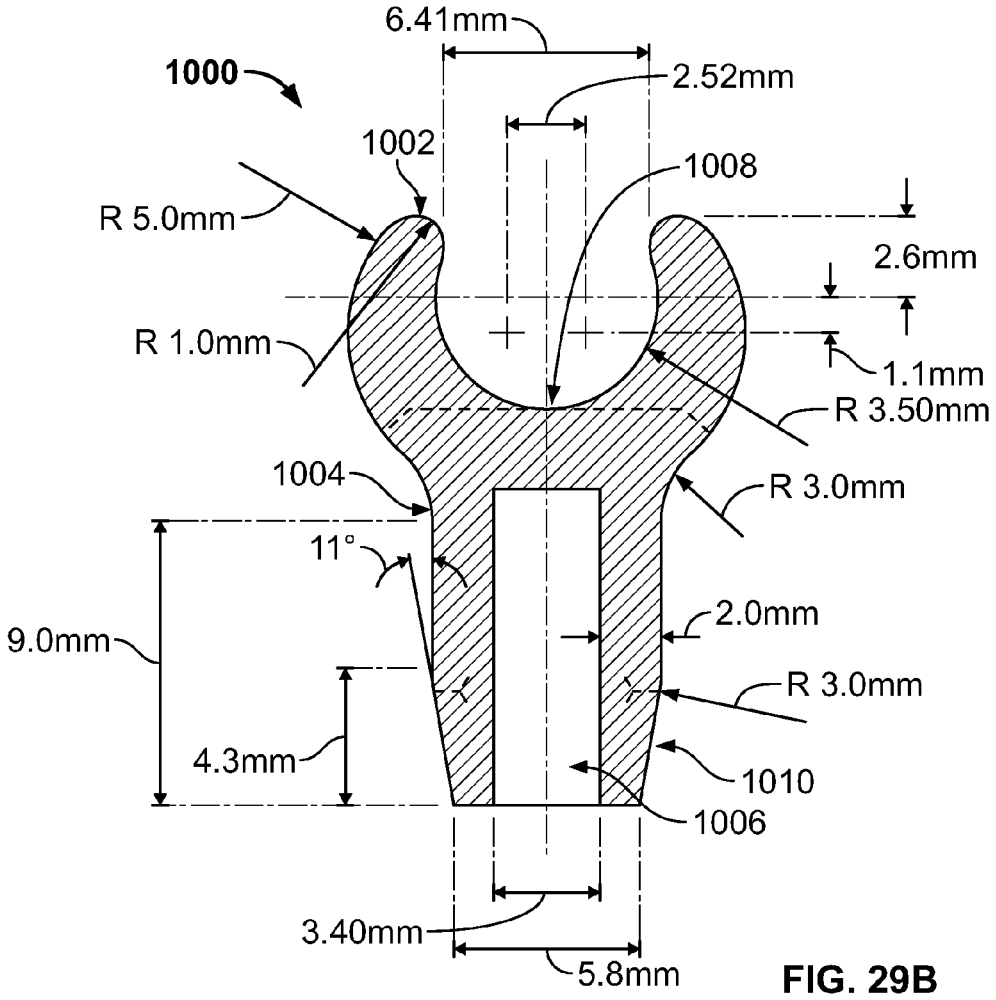
FIG. 29B is a sectional front view of the hang rod saddle of FIG. 27 with dimensions provided for purpose of illustration only.
Figure 30A:
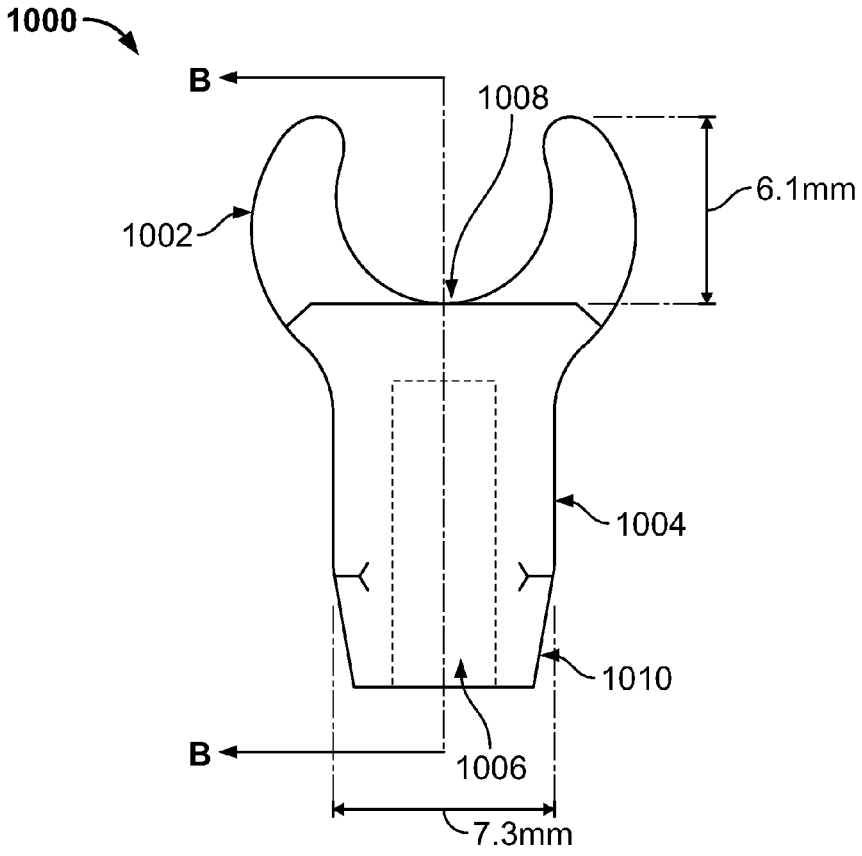
FIG. 30A is a front view of the hang rod saddle of FIG. 27 with dimensions provided for purpose of illustration only.

The upper saddle portion 1002 may have a generally U-shaped profile as shown in FIG. 27 (and FIGS. 29B and 30A). The U-shaped profile may include the channel 1008. The U-shaped profile may include a centerline that is aligned with the lower saddle portion 1004. For example, FIG. 29B illustrates a section view of the U-shaped profile of the upper saddle portion 1002 having a centerline that is aligned with a centerline of the lower saddle portion 1004. The saddle 1000 is substantially symmetrical about this centerline. In some embodiments, the upper saddle portion 1002 and the lower saddle portion 1004 may not be aligned, the saddle 1000 may not be symmetrical along this centerline, etc.

The interior diameter of the upper saddle portion 1002 may correspond to an outer diameter of a rod received in the upper saddle portion 1002. For example, the rod may substantially fill the U-shaped profile of the upper saddle portion 1002 when the rod is received in the U-shaped profile. The rod may be received in the upper saddle portion 1002 with a friction fit, compression fit, snap fit, etc. Once the rod is received in the upper saddle portion 1002, the upper saddle portion 1002 may inhibit the rod from being removed. In some embodiments, the upper saddle portion 1002 may inhibit the rod from sliding axially in the upper saddle portion 1002. In other embodiments, the rod may be allowed to slide along an axial direction through the channel 1008 of the upper saddle portion 1002.

Figure 28:
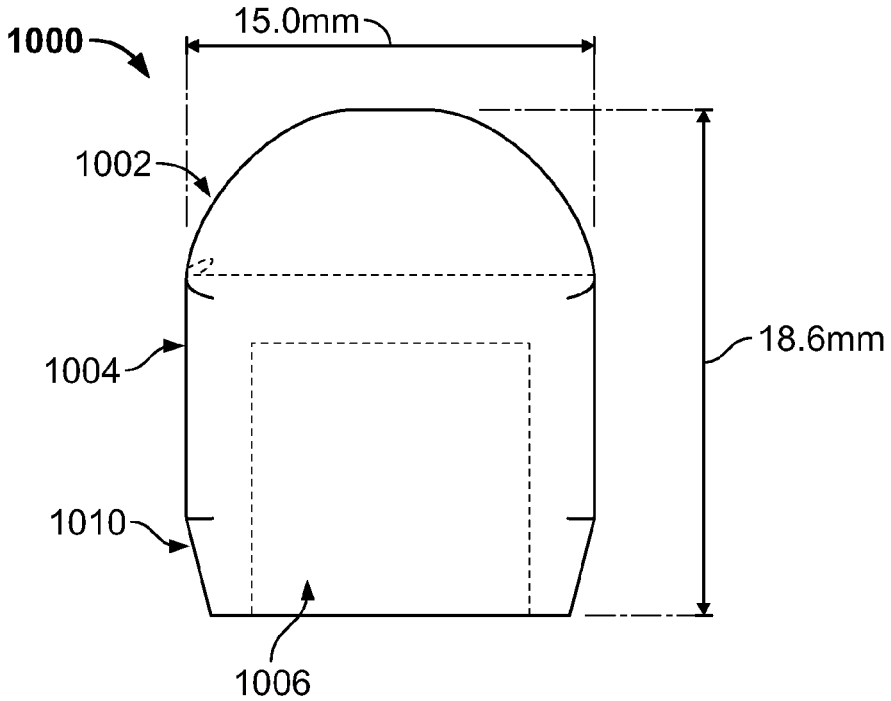
FIG. 28 is a side view of the hang rod saddle of FIG. 27 with dimensions provided for purpose of illustration only.

FIG. 28 illustrates a side view of the saddle 1000. As shown in dashed lines, the lower saddle portion 1004 defines an opening 1006. The opening 1006 may be used to releasably couple the saddle 1000 on an end of a bracket. For example, the bracket may include an end which can be inserted into the opening 1006 of the saddle 1000, the opening 1006 may be placed about the end of the bracket, etc. The opening 1006 may have a shape corresponding to a profile of the end portion of the bracket such that the end portion of the bracket can be received in the opening 1006. For example, the opening 1006 may be a generally rectangular slot and the bracket may have a generally rectangular profile. Other embodiments may include other suitable shapes for opening 1006 (e.g., circular, square, triangular, hexagonal, etc.). The opening 1006 may create a friction fit, interference fit, compression fit, snap fit, etc., when coupled to the end portion of the bracket such that the saddle 1000 is inhibited from being removed after the saddle 1000 is mounted to the bracket.

FIG. 29A is a top view of the saddle 1000. As shown in FIG. 29A, the rectangular opening 1006 may be substantially parallel to the axial direction of the upper saddle portion 1002 (e.g., may be parallel to the channel 1008, the rod received in the upper saddle portion, etc.).

As shown in FIGS. 27 and 28, the lower saddle portion 1004 may include a taper 1010. The taper 1010 may define a lower saddle portion 1004 shape that is narrower adjacent the opening 1006. The taper 1010 may provide increased aesthetic appearance of the saddle 1000, require less material to form the saddle 1000, etc.

Figure 30B:
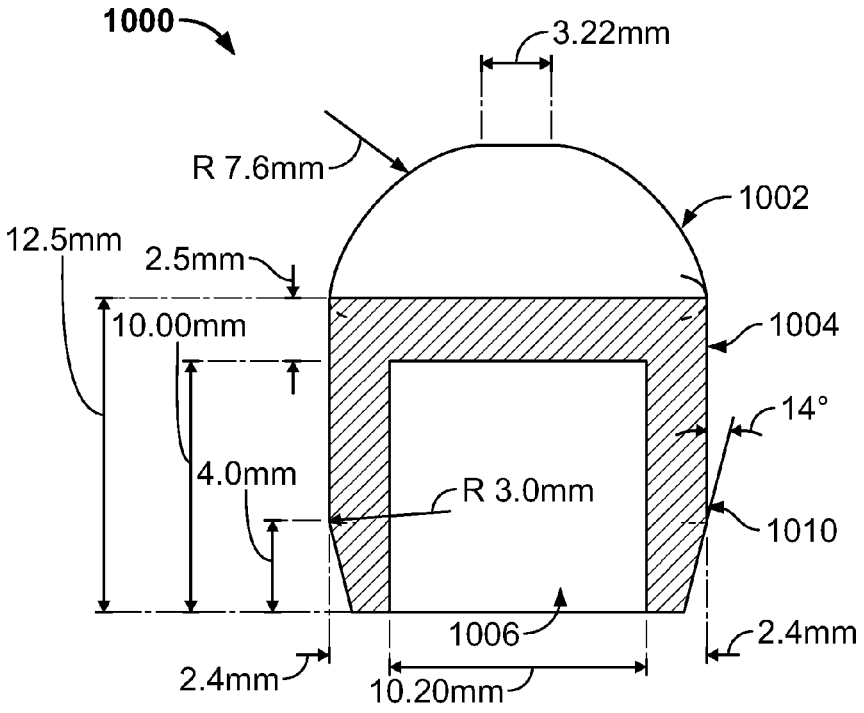
FIG. 30B is a sectional side view of the hang rod saddle of FIG. 27 with dimensions provided for purpose of illustration only.

FIG. 29B is a sectional front view of the saddle 1000, FIG. 30A is a front view of the saddle 1000 which is similar to FIG. 29B, and FIG. 30B is a sectional side view of the saddle 1000 which is similar to FIG. 28. The dimensions in FIGS. 28-30 are for purposes of illustration only and other embodiments may include other saddle dimensions.

FIGS. 28-30 illustrate that the saddle 1000 may be symmetrical along a centerline vertically dividing a front view (FIG. 29B and FIG. 30A), may be symmetrical along a centerline vertically dividing a side view (FIGS. 28 and 30B), and may be symmetrical along a centerline vertically dividing a top view (FIG. 29A) along an axial direction of the channel 1008.

The saddle 1000 may be made of any suitable material (e.g., plastic, metal, etc.), which may be the same and/or different as the material used in the coupled brackets, rods, etc. The saddle 1000 may be molded in an injection molding process. The saddle 1000 may include any suitable coating (e.g., finish coating, paint, protective sealant, etc.).

The saddle 1000 may provide one or more (but not necessarily any or all) of the following advantages, including, for example, providing releasable coupling of saddles at end portions of brackets, providing releasable coupling of rods into the upper saddle portions of the saddles, inhibiting removal of rods from the saddles, inhibiting removal of saddles from the end portions of brackets, etc.

FIGS. 31-36 illustrate a rod support 1100 (e.g., rod coupler, bracket mounted rod support, etc.) according to another example embodiment of the present disclosure. The rod support 1100 may be coupled to a bracket to support one or more rods. For example, the rod support 1100 may be configured to couple to any suitable bracket, including the brackets described herein (e.g., bracket 112, 212, 312, 412, 512, 712, etc.), and may be configured to releasably couple and/or support any suitable rod including the rods described herein (e.g., rods 114, 214, 314, 514, 614, 714, etc.).

Figure 31:
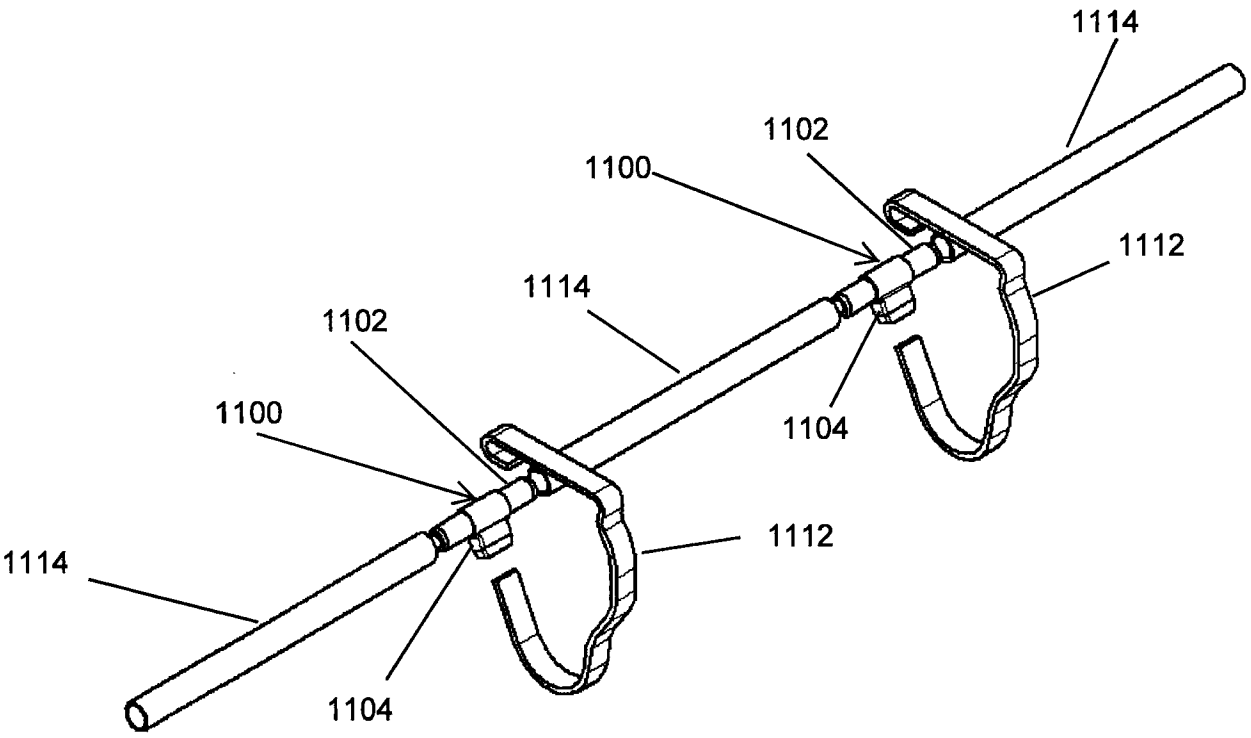
FIG. 31 is a perspective view of rod support in a hanger assembly according to another example embodiment of the present disclosure.

FIG. 31 illustrates an example hanger assembly including two rod supports 1100. The rod support 1100 includes a lower rod support portion 1104 which defines an opening for coupling (e.g., mounting, etc.) to a bracket 1112. The rod support 1100 also includes two rod end portions having extensions 1102 configured to receive an end of a rod 1114. For example, each rod support 1110 in FIG. 31 has a rod 1114 coupled at each end. Accordingly, a rod 1114 may be coupled between two rod supports 1100, such that the rod 1114 is supported by the two rod supports 1100. The rod 1114 may be coupled to the rod support 1100 by inserting an opening at an end of the rod 1114 about an extension 1102 of the rod support 1100, as shown in FIG. 31.

Figure 32A:
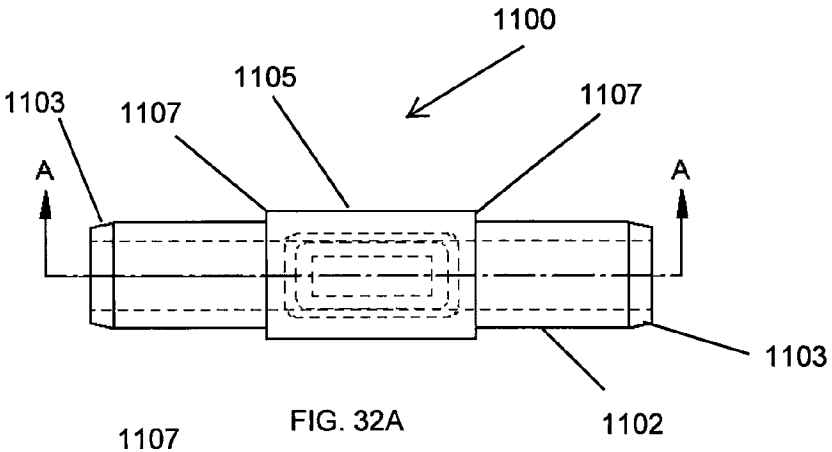
FIG. 32A is a top view of the rod support of FIG. 31.

FIG. 32A illustrates a top view of the rod support 1100. As shown in FIG. 32A, the rod support 1100 may include rod end portions having extensions 1102. The extensions 1102 may be configured to receive an end of a rod. For example, an outer diameter of the rod extensions 1102 may correspond to an inner diameter of an opening at an end of a rod, such that the opening at the end of the rod can be placed about the rod extension 1102. The rod may be coupled to the rod extension 1102 using a friction fit, compression fit, etc.

The rod extensions 1102 may include chamfered edges 1103, which may allow for easier coupling of a rod to the rod extensions 1102. For example, the chamfered edges 1103 may make it easier to place an opening of a rod about the end of the rod extension 1102.

The rod support 1100 also includes a central portion 1105. The central portion 1105 may couple the rod extensions 1102 to the lower portion 1104 of the rod support, as shown in the cross section view of FIG. 32B.

The central portion 1105 may have a larger diameter than the extensions 1102, which may create a central portion lip 1107 (e.g., a stop, a ridge, a wall, etc.). The central portion lip 1107 may contact an end of a rod when the rod is coupled to an extension 1102, thereby controlling how far the rod may be placed about the extension. For example, the lip 1107 may determine how far the extension 1102 can be inserted into an opening at the end of the rod and may serve as a guide to position the rod at a desired distance along the extension 1102.

Figure 32B:
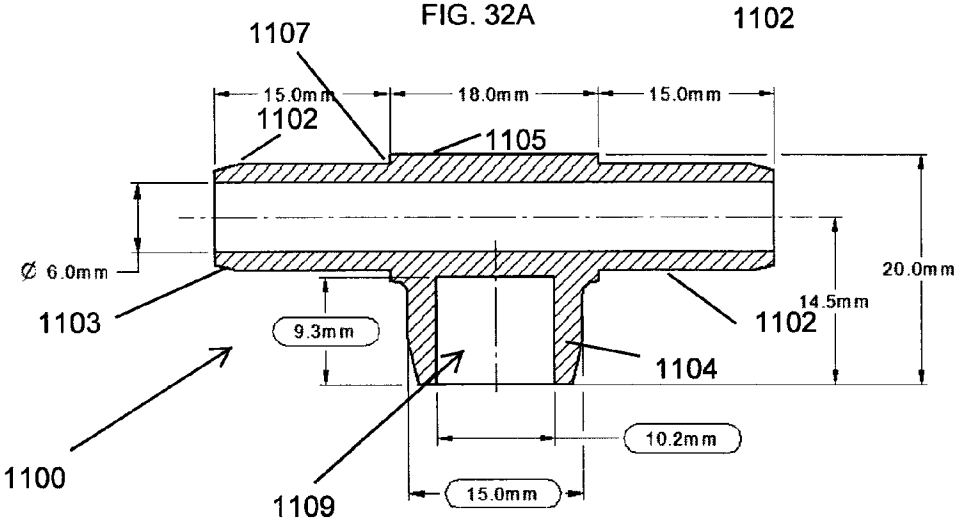
FIG. 32B is a sectional view front view of the rod support of FIG. 32A with dimensions provided for purpose of illustration only.

As shown in FIG. 32B, the extensions 1102 may extend in opposite directions from one another. The extensions 1102 may be substantially parallel. The extensions 1102 may be substantially perpendicular to a longitudinal axis of the opening 1109 of the lower portion 1104.

The extensions 1102, central portion 1105 and lower portion 1104 may be formed integrally, made from the same material, made from different materials, be defined by one or more components that are coupled together, etc. The extensions 1102 and/or central portion 1105 may be hollow as shown in FIG. 32B. In other embodiments the extensions 1102 and/or central portion 1105 may be solid. The rod support 1100 may be made out of any suitable materials, including plastic, metal, wood, etc.

Figure 33B:
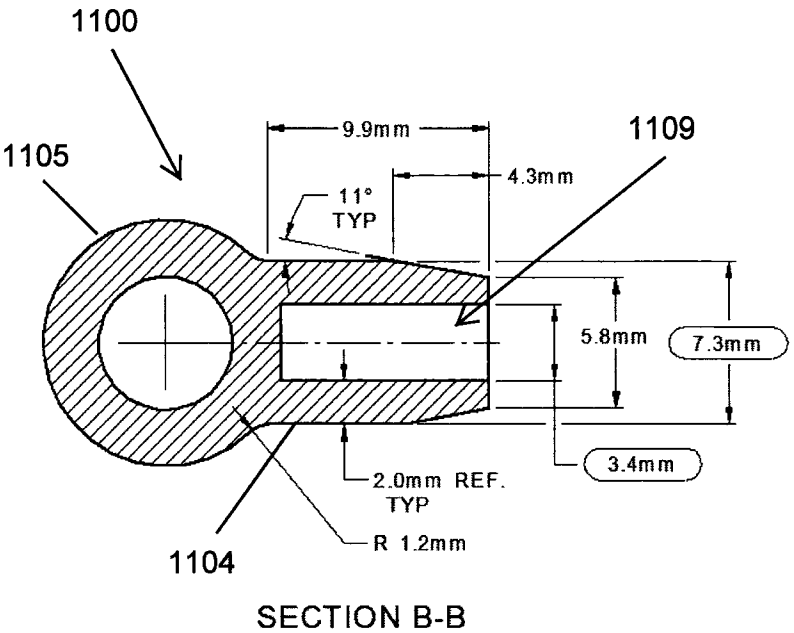
FIG. 33B is a sectional side view of the rod support of FIG. 33A with dimensions provided for purpose of illustration only.
Figure 33A:
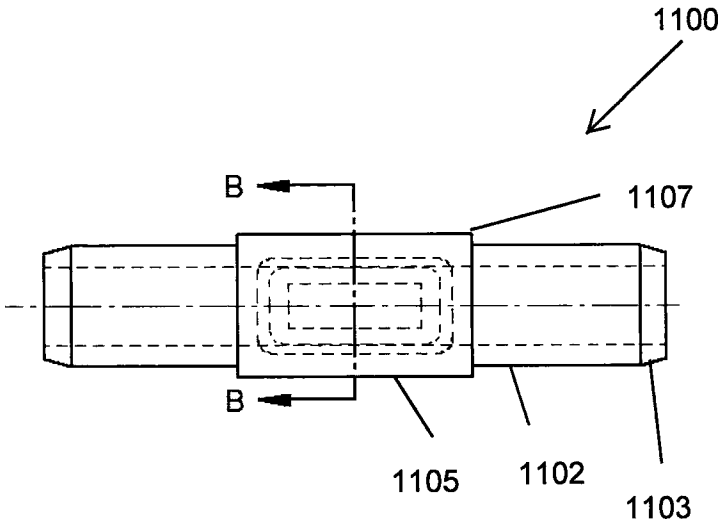
FIG. 33A is another top view of the rod support of FIG. 31.

FIGS. 33A and 33B illustrate top and side sectional views of the rod support 1100, including the lower portion 1104 and the opening 1109 of the lower portion 1104. The shape of the opening 1109 may be defined to correspond to an end of a bracket so that the rod support 1100 can be coupled to the bracket by placing the opening 1109 about the end of the bracket. The lower portion 1104 and opening 1109 may be similar to the lower saddle portion 1004 and opening 1006 of the saddle 1000 of FIGS. 28-30, and may include the same shapes, taper, etc. described above relative to the saddle 1000. Accordingly, the rod support 1100 may be coupled to a bracket in a similar manner as the saddle 1000.

Figure 34:
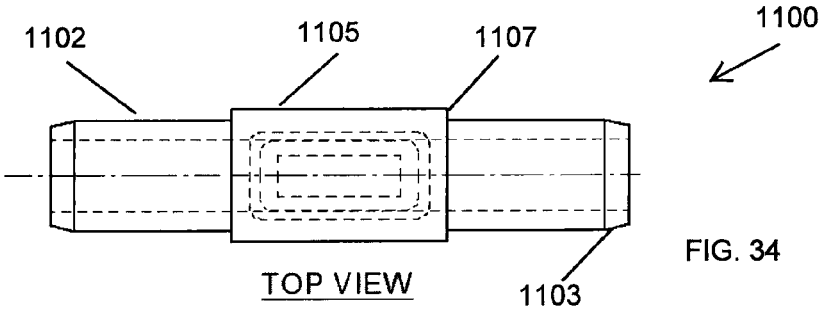
FIG. 34 is another top view of the rod support of FIG. 31.
Figure 35:
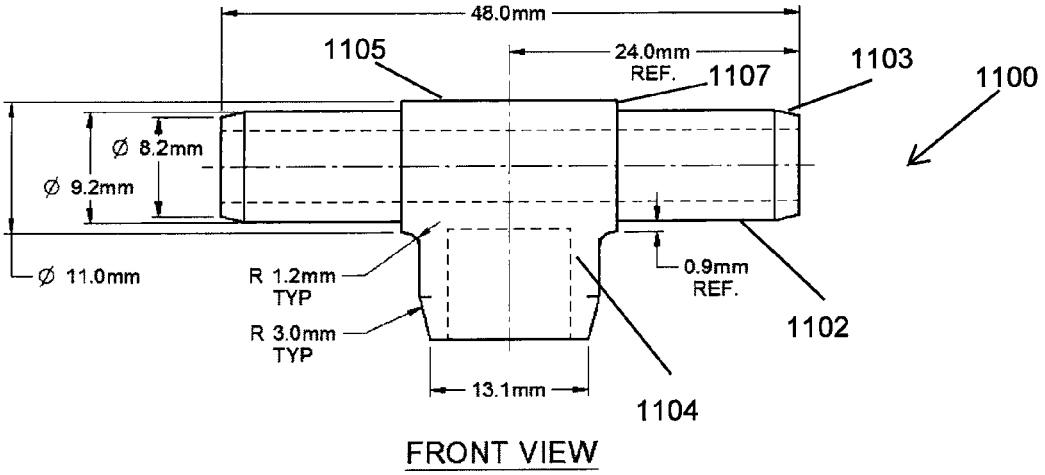
FIG. 35 is a front view of the rod support of FIG. 31 with dimensions provided for purpose of illustration only.
Figure 36:
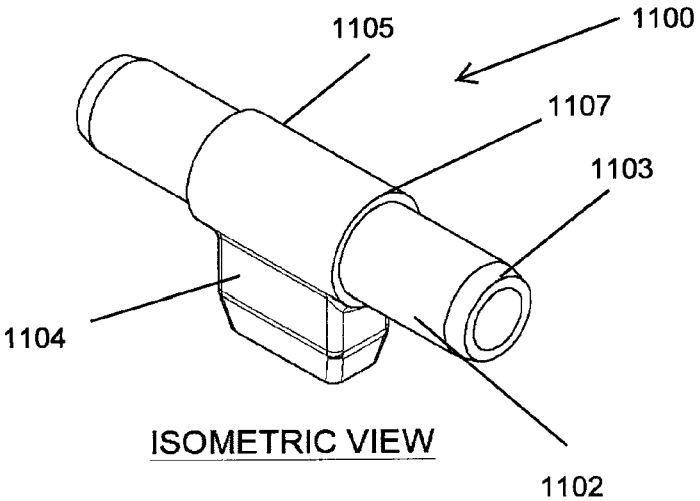
FIG. 36 is an isometric view of the rod support of FIG. 31.

FIGS. 34-36 illustrate additional top, front and isometric views of the rod support 1100. Example dimensions provided for the rod support 1100 in each of the figures are provided for purpose of illustration only. Other embodiments may include rod supports having any other suitable dimensions.

Specific dimensions included herein are exemplary in nature and do not limit the scope of the present disclosure. In addition, specific dimensions included herein are provided within acceptable tolerances generally common in the art (e.g., dimensions with no decimal point may include tolerances of +/−1.0 mm (0.04 inches); dimensions with one decimal point may include tolerances of +/−0.3 mm (0.01 inches); dimensions with two decimal points may include tolerances of +/−0.13 (0.005 inches); angular dimension may include tolerances of +/−2 degrees; etc.).

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A hanger assembly for use with a wire shelf, the hanger assembly comprising:

at least one bracket configured to releasably couple to wire members of the wire shelf, the bracket including a hook-shaped end portion and an elbow portion, the hook-shaped end portion of the bracket defining a channel that opens toward the elbow portion for receiving a first one of the wire members, and the elbow portion of the bracket defining a bend for receiving a second one of the wire members to thereby releasably couple the bracket to the wire shelf with the first and second one of the wire members disposed within a common interior region defined between the hook-shaped end portion and the elbow portion when the bracket is releasably coupled to the wire shelf, the bracket further including a second end portion opposite the hook-shaped end portion and a U-shaped portion defined between the elbow portion and the second end portion such that the second end portion extends generally back towards the elbow portion and the hook-shaped portion; and a rod coupled to the bracket;

wherein the bracket further includes a generally straight upper member extending between the hooked-shaped end portion and the elbow portion such that the upper member spans over and across a horizontal distance separating the first and second ones of the wire members when the bracket is releasably coupled to the first and second ones of the wire members of the wire shelf; and wherein the bracket is defined by a single piece of flat wire or sheet metal having a generally uniform thickness along an entire length of the bracket.

2. The hanger assembly of claim 1, wherein:

the bracket defines a general C shape; and/or the bracket includes a rounded lip portion defined between the elbow portion and the U-shaped portion and protruding toward a forward portion of the bracket.

3. A hanger assembly for use with a wire shelf, the hanger assembly comprising:

at least one bracket configured to releasably couple to wire members of the wire shelf, the bracket including a hook-shaped end portion and an elbow portion, the hook-shaped end portion of the bracket defining a channel that opens toward the elbow portion for receiving a first one of the wire members, and the elbow portion of the bracket defining a bend for receiving a second one of the wire members to thereby releasably couple the bracket to the wire shelf with the first and second one of the wire members disposed within a common interior region defined between the hook-shaped end portion and the elbow portion when the bracket is releasably coupled to the wire shelf, the bracket further including a second end portion opposite the hook-shaped end portion and a U-shaped portion defined between the elbow portion and the second end portion such that the second end portion extends generally back towards the elbow portion and the hook-shaped portion; and a rod coupled to the bracket;

wherein the bracket further includes a generally straight upper member extending between the hooked-shaped end portion and the elbow portion such that the upper member spans over and across a horizontal distance separating the first and second ones of the wire members when the bracket is releasably coupled to the first and second ones of the wire members of the wire shelf; and wherein the first and second ones of the wire members of the wire shelf extend generally parallel to the rod, wherein the first and second ones of the wire members are forward and rearward support members of the wire shelf that are horizontally spaced apart, and wherein the channel defined by the hook-shaped end portion opens rearwardly toward a rearward portion of the bracket.

4. The hanger assembly of claim 3, wherein the bend of the elbow portion defines a radial angle greater than ninety degrees to thereby facilitate a snap-fit engagement of the bracket to the wire shelf, and wherein the bracket is made of flat wire such that the bracket is a snap-on flat wire bracket.

5. The hanger assembly of claim 3, wherein the bracket is defined by a single piece of flat wire or sheet metal having a generally uniform thickness along an entire length of the bracket.

6. A hanger assembly for use with a wire shelf, the hanger assembly comprising:

at least one bracket configured to releasably couple to wire members of the wire shelf, the bracket including a hook-shaped end portion and an elbow portion, the hook-shaped end portion of the bracket defining a channel that opens toward the elbow portion for receiving a first one of the wire members, and the elbow portion of the bracket defining a bend for receiving a second one of the wire members to thereby releasably couple the bracket to the wire shelf with the first and second one of the wire members disposed within a common interior region defined between the hook-shaped end portion and the elbow portion when the bracket is releasably coupled to the wire shelf, the bracket further including a second end portion opposite the hook-shaped end portion and a U-shaped portion defined between the elbow portion and the second end portion such that the second end portion extends generally back towards the elbow portion and the hook-shaped portion; and a rod coupled to the bracket;

wherein the bracket includes a rounded lip portion defined between the elbow portion and the U-shaped portion and protruding toward a forward portion of the bracket; and wherein the bracket includes a bump-out portion defined between the rounded lip portion and the U-shaped portion and protruding away from a forward portion of the bracket.

7. A hanger assembly for use with a wire shelf, the hanger assembly comprising:

at least two brackets configured to releasably couple to wire members of the wire shelf, each bracket including a hook-shaped end portion and an elbow portion, the hook-shaped end portion of the bracket defining a channel that opens toward the elbow portion for receiving a first one of the wire members, and the elbow portion of the bracket defining a bend for receiving a second one of the wire members to thereby releasably couple the bracket to the wire shelf;

a first rod coupled to a first of the at least two brackets;

a second rod coupled to a second of the at least two brackets; and a rod joiner coupled between the first rod and the second rod to space the first rod and the second rod apart, the rod joiner defining a first opening at a first end for receiving the first rod and a second opening at a second end for receiving the second rod.

8. The hanger assembly of claim 7, wherein the first rod and the second rod are separated by a distance approximately equal to a length of the rod joiner.

9. The hanger assembly of claim 7, wherein the first opening of the rod joiner includes a chamfered interior edge and the second opening of the rod joiner includes a chamfered interior edge.

10. The hanger assembly of claim 7, wherein the rod joiner is a hollow cylindrical rod having a central channel extending from the first opening to the second opening.

11. The hanger assembly of claim 7, wherein the first rod and the second rod are each coupled to the rod joiner with a friction and/or a compression fit.

12. The hanger assembly of claim 11, wherein an inner diameter of the first opening of the rod joiner corresponds to an outer diameter of the first rod and an inner diameter of the second opening of the rod joiner corresponds to an outer diameter of the second rod.

13. The hanger assembly of claim 12, wherein the first opening of the rod joiner and the second opening of the rod joiner are substantially a same.

14. A hanger assembly for use with a wire shelf, the hanger assembly comprising:

a bracket configured to releasably couple to wire members of the wire shelf, the bracket including a hook-shaped end portion and an elbow portion, the hook-shaped end portion of the bracket defining a channel that opens toward the elbow portion for receiving a first one of the wire members, and the elbow portion of the bracket defining a bend for receiving a second one of the wire members to thereby releasably couple the bracket to the wire shelf, the bracket further including a second end portion opposite the hook-shaped end portion; and a rod support having a lower portion, a first rod end portion and a second rod end portion;

wherein the lower portion defines an opening for receiving the second end portion of the bracket to thereby mount the rod support to the bracket, the first rod end portion defines a first extension configured to receive an end of a first rod, and the second rod end portion defines a second extension configured to receive an end of a second rod end.

15. The hanger assembly of claim 14, further comprising:

a first rod having an end coupled to the first rod end portion of the rod support; and a second rod having an end coupled to the second rod end portion of the rod support.

16. The hanger assembly of claim 15, wherein:

an outer diameter of the first extension of the rod support corresponds to an inner diameter of an opening of the first rod; and an outer diameter of the second extension of the rod support corresponds to an inner diameter of an opening of the second rod.

17. The hanger assembly of claim 14, wherein the first extension of the rod support and the second extension of the rod support extend in opposite directions and are substantially parallel.

18. The hanger assembly of claim 14, wherein the first extension of the rod support and the second extension of the rod support are substantially perpendicular to a longitudinal axis of the opening defined by the lower portion of the rod support.

19. The hanger assembly of claim 14, wherein the rod support includes a central portion coupled between the first extension, the second extension and the lower portion of the rod support, and the central portion has a larger diameter than a diameter of at least one of the extensions, thereby defining a stop to contact an end of a rod disposed about one of the extensions.

* * * * *